US010966041B2

(12) United States Patent
Torres Ayala et al.

(10) Patent No.: US 10,966,041 B2
(45) Date of Patent: Mar. 30, 2021

(54) AUDIO TRIANGULAR SYSTEM BASED ON THE STRUCTURE OF THE STEREOPHONIC PANNING

(71) Applicants: Gilberto Torres Ayala, Jalisco (MX); Sonia Gladys Luque Vela, La Molina (PE)

(72) Inventors: Gilberto Torres Ayala, Jalisco (MX); Sonia Gladys Luque Vela, La Molina (PE)

( * ) Notice: Subject to any disclaimer, the term of this patent is extended or adjusted under 35 U.S.C. 154(b) by 0 days.

(21) Appl. No.: 16/419,797

(22) Filed: May 22, 2019

(65) Prior Publication Data

US 2020/0120435 A1 Apr. 16, 2020

Related U.S. Application Data

(60) Provisional application No. 62/745,008, filed on Oct. 12, 2018.

(51) Int. Cl.
*H04R 5/02* (2006.01)
*H04R 5/04* (2006.01)
(Continued)

(52) U.S. Cl.
CPC ..... *H04S 3/002* (2013.01); *H04R 3/12* (2013.01); *H04R 5/02* (2013.01); *H04R 5/04* (2013.01);
(Continued)

(58) Field of Classification Search
CPC ..... H04R 2205/024; H04R 3/12; H04R 5/02; H04R 5/04; H04S 2400/01; H04S 2400/05; H04S 3/002
(Continued)

(56) References Cited

U.S. PATENT DOCUMENTS 3,632,886 A 1/1972 Scheiber
3,745,254 A 7/1973 Ohta et al.
(Continued)

FOREIGN PATENT DOCUMENTS

GB 2082418 3/1982
WO 9520306 7/1995
WO 02065815 8/2002

OTHER PUBLICATIONS

Pulkki et al., "Creating auditory displays with multiple loudspeakers using VBAP: a case study with DIVA project," ICAD, 1998, p. 1-5.
(Continued)

*Primary Examiner* — Jason R Kurr
*Assistant Examiner* — Friedrich Fahnert
(74) *Attorney, Agent, or Firm* — Christopher M. Scherer; DeWitt LLP

(57) ABSTRACT

The present invention presents an audio triangular system based in the structure of panning in the stereophonic mix, said audio triangular system uses 2 input audio channels and 3 output mono audio playback systems, also creates an assignment of panning values to obtain the audio signals corresponding to each one of the three mono audio playback systems, it is important to mention that the interaction of the audio signals obtained from the previous assignment of values causes the triangular effect of the present invention, additionally, the previously mentioned 3 mono audio playback systems must be capable of reproduce a full frequency range of treble, mid and bass tones each one, furthermore, said mono audio playback systems should be located at a certain distance and angles from each other and in relation to the listener.

24 Claims, 22 Drawing Sheets

(51) Int. Cl.
*H04R 3/12* (2006.01)
*H04S 3/00* (2006.01)

(52) U.S. Cl.
CPC .... *H04R 2205/024* (2013.01); *H04S 2400/01* (2013.01); *H04S 2400/05* (2013.01)

(58) Field of Classification Search
USPC ..... 381/1, 17, 18, 19, 27, 56, 99, 104, 118, 381/119, 300
See application file for complete search history.

(56) References Cited

U.S. PATENT DOCUMENTS 3,746,792 A 7/1973 Scheiber
3,761,631 A 9/1973 Ito et al.
3,959,590 A 5/1976 Scheiber
4,524,451 A 6/1985 Watanabe
4,612,663 A 9/1986 Holbrook et al.
4,747,142 A 5/1988 Tofte
5,440,638 A 8/1995 Lowe et al.
5,610,985 A 3/1997 Ten Kate
8,320,590 B2 * 11/2012 Sungyoung ..... H04S 3/002 381/27
8,705,769 B2 4/2014 Vickers
8,824,709 B2 9/2014 Li
9,084,047 B2 7/2015 O'Polka
9,332,370 B2 5/2016 Zajac et al.
10,567,871 B1 * 2/2020 Milne ..... H04R 29/001
2002/0181713 A1 * 12/2002 Kato ..... H04S 7/30 381/56
2005/0254668 A1 * 11/2005 Gentele ..... H04R 3/14 381/99
2007/0286426 A1 12/2007 Xiang et al.
2009/0304189 A1 * 12/2009 Vinton ..... H04S 5/00 381/27
2012/0213375 A1 * 8/2012 Mahabub ..... H04S 5/00 381/17
2014/0355773 A1 * 12/2014 North ..... H04S 5/00 381/27
2017/0366912 A1 * 12/2017 Stein ..... H04S 7/304
2018/0014138 A1 * 1/2018 Hess ..... H04S 5/02
2019/0305743 A1 * 10/2019 Ramos ..... H03G 11/00

OTHER PUBLICATIONS

Serrano, "Application of sound source separation methods to advanced spatial audio systems," Doctoral Thesis, Universidad Politecnica de Valencia, Jun. 2009.

* cited by examiner

Sound level $L$ and Distance $r$ $$L_2 = L_1 - \left|20 \cdot \log\left(\frac{r_1}{r_2}\right)\right| \qquad L_2 = L_1 - \left|10 \cdot \log\left(\frac{r_1}{r_2}\right)^2\right|$$

$$r_2 = r_1 \cdot 10^{\left(\frac{|L_1 - L_2|}{20}\right)} \qquad r_1 = \frac{r_2}{10^{\left(\frac{|L_1 - L_2|}{20}\right)}}$$

FIG. 17

Embodiment $X_2,Z_2,Y_2$

Embodiment $X_3,Z_3,Y_3$

AUDIO TRIANGULAR SYSTEM BASED ON THE STRUCTURE OF THE STEREOPHONIC PANNING

FIELD

The present invention is related to audio systems, specifically it is related to an "audio triangular system," based on the panning structure of stereophonic music, but represented in a triangular space, which allows to create a sonorous panoramic with its body outside its horizontal front line, which is totally different from the known stereo systems, thus giving the opportunity to recognize and feel each instrument as if they were physically in a place in space.

The audio triangular system of the present invention enhances any stereophonic panned mixture, since it gives the deserved prominence to each sound and instrument, recovers and transmits all the details of the original recording, gives a greater location to the sound transmitting from a frontal semicircle towards the listener, generates virtual points that are created naturally and the sum of all these factors provoke an ideal sense of realism and appreciation for the user. The audio triangular system of the present invention works for the already created stereophonic audios, therefore, the better the stereo panning, the better the final listening experience will be.

BACKGROUND

Over the years, new audio systems have emerged that, due to the scarcity of a more realistic experience in the conventional stereo system, have sought to offer more audio quality and definition, a greater volume and an extensive number of audio outputs that goes from the classic 2.1 to 5.1, 7.1, 9.2, etc., in addition to surround and 3D sound systems.

All the above has had a noticeable improvement, mainly in the field of cinema and home theater systems, leaving completely forgotten the musical field, since most of the recordings and musical mixes have been kept in the classic stereo system, and none of the aforementioned playback systems have been used for music, hence it is still listened in its original stereo format for more than 50 years.

In view of this need, the present invention is conceived, which hereby will be referred as audio triangular system. This invention can create and improve that feeling of atmospheric-spatial realism of music stereophonically recorded, mixed and panned.

In addition to improving the appreciation of stereo music as its main objective, the audio triangular system is useful for improving the appreciation of audio in movies, music videos or video games. Essentially, it is useful for any audio recorded, mixed, and panned stereophonically.

The audio triangular system is based on the musical stereophonic panning to create a semicircular triangular panoramic in the physical space of the sound during the playback, very different from the linear panoramic reflected in the stereophonics replay.

Before going into detail to the specification and operation of the invention, it is important to mention the current audio systems related to the stereophonics and understand their basic functions to compare them with the enhances and benefits of the audio triangular system disclosed herein.

Audio Playback Systems—Environment

The current audio playback systems related to the stereophonics are:

1) Monophonic Playback Systems

2) Stereophonic Playback Systems

3) Stereophonic Playback Systems with 2, 3, or 4 frequency channels

4) Binaural

5) Holophonics

Monophonic Playback System:

The monophonic system is defined by the transmission in a single channel (either a recording captured with a single microphone or well a final mix), its playback equipment comprises a single audio output, therefore, it must comprise a speaker and its own amplifier capable of replaying a complete range of treble, mid and bass frequencies. See FIG. 1 for reference.

Monaural playback lacks the spatial sensation that stereophonic playback provides.

Stereophonic Playback System:

The stereophonic system is that mixed, panned and reproduced in two channels. Nowadays, most of the streaming platforms, mobile audio devices, FM radio stations, CD's, TV channels etc. transmit stereophonic audio signals. The purpose of mixing in stereophonics is to recreate a more natural listening experience, this is done by emitting the sounds through its right and left audio outputs in the same way they were picked up during recording or in the way it was decided during the panning process.

Although stereo sound may have two independent monophonic channels, usually the signal on one channel is related to the signal of the other channel. By way of non-limiting example, if the exact same signal was recorded on both channels, then it would be heard as a "phantom" center sound when it was played on loudspeakers. That is to say, the sound seems to come from the midpoint between the two speakers. See FIG. 2 as reference.

Stereo Playback Systems with 2, 3, 4 Frequency Ways

This system is the same as the previous one, with the difference that more speakers are added to each loudspeaker, each speaker emitting at different frequency tones, in this way, the loudspeaker manages to divide its bass, mid and treble tones range for emitting with a greater fidelity during the playback from each channel.

a) 2 frequency ways: composed of 1 bass-mid speaker plus 1 treble speaker.

b) 3 frequency ways: composed of 1 bass speaker+1 mid speaker+1 treble speaker.

c) 4 frequency ways: composed of 1 bass speaker+1 mid-bass speaker+a mid-treble speaker+a treble speaker. See FIG. 3 as reference.

Binaural

Binaural is a recording system which has the purpose of causing to the listener a realistic effect when listening the audio, especially it is used for recording environmental sounds, this technique consists in recoding the sound using two microphones located in such a way that they simulate being the human ears of the listener, which perceive and capture the surrounding sound, it is important to point out that in order to listen an audio recorded in a binaural system, it is necessary to do it through headphones, otherwise, the recording effect will not be achieved.

Holophony

Holophony uses a recording system which is based on a simulation of a human head with microphones located in the ears position with relation to the human anatomy, said recording system was named as "Ringo", said device with the shape of a human head named "Ringo" captures the sounds that come from its surroundings and playback the sound strictly by means of headphones, in this way, the user listen the sound in the same way at it was captured by the "Ringo" head. It is important to mention that said device simulate the inner shape of the human ears in the space of its microphones, by this way, it is intended to be sure that the recording will be appreciated in the same way as our ears does. See FIG. 4 as reference.

The holophony and binaural recording systems make use of psychoacoustics which tricks the brain in order to feel that the sound is perceived from a specific direction.

Also, before starting to detail the present audio triangular system it is fundamental to know how stereophonic musical mixes are made, in order to understand how the audio triangular system works.

In sound playback and recording, mixing audio is the process by which multiple recorded sounds are combined within one or more channels.

The stereophonic mix technique consists of the incorporation of two different reproduction channels that feed each one to a speaker or loudspeaker. Each channel emits different information, thus allowing the ear to identify the audio sources in a horizontal plane, that is to say, from right to left or vice versa. The stereophonic mixing technique also allows to position sounds in the middle of both speakers to what is called "phantom center" and is achieved by locating the same sound with the same volume level on both the left and right sides.

To decide where to send each sound, modern consoles and sequencers have included a potentiometer called "pan pot" which function is to locate the signals in the horizontal plane from left to right or vice versa, thus, it manages to send more or less signal to each channel depending on the position in which it is desired to locate the sound.

In the playback of the stereophonic system there is a maximum point of appreciation of the sound and its location in the horizontal line from left to right or vice versa, including the phantom center, to achieve this, it is necessary that the listener be at the privileged point known as "sweet spot" that is formed with an equilateral triangle between the left and right front speakers and the ears of the listener the angles of said equilateral triangle correspond to 60° for each corner as shown in FIG. 5.

Another important point to consider is that, to obtain a better result in the stereophonic mix, it is necessary to think about the stereophonic arrangement of the instruments from the recording process, as a consequence, it is impossible that all the music recorded in stereo have a well done and complete left-to-right, or vice versa, panning, since many artists decide to include less and less arrangements and instruments, leaving the musical material almost or even in some cases, in monophonic version.

Technical Performance of Audio Panning in Stereophonic.

To understand how the audio triangular system provides all its benefits, it is necessary to understand the stereophonic panning principles, so we will explain this below.

In the panning of a stereophonic mix, the sounds are placed in a location of the horizontal plane in front of the user formed by the left and right channels in which, in order to place a voice sound in the center (phantom center), 50% of the total volume of the sound is sent to the left channel and 50% of the total volume of the same sound is sent to the right channel.

Following the previous method, if is desired to load a guitar sound completely to the left, 100% of the volume of the sound will be sent to the left speaker and 0% of the volume of the same sound will be sent to the right speaker, in the same way, when placing the sound of a piano completely to the right, 100% of the volume of the sound will be sent to the right speaker and 0% of the volume of the same sound will be sent to the left speaker, as can be seen in FIG. 6.

In the stereophonic system, a "n" number of panoramic points can be located, which delimit the location of the sounds, but they will always be in a horizontal frontal plane taking the sound from left to right, or vice versa, according to the panning that is made.

There are 5 main audio panning points in the stereophonic mixes, and we will represent them as A, B, C, D, E, which are formed according to the following location percentages of each channel and can be seen in FIG. 7:

Point "A" is formed by 100% of the audio of the left channel and 0% of the audio of the right channel.

Point "B" is formed by 100% of the audio of the right channel and 0% of the audio of the left channel.

The "C" point is formed by 50% of the audio of the left channel and 50% of the audio of the right channel.

The "D" point is formed by 75% of the audio of the left channel and 25% of the audio of the right channel.

The "E" point is formed by 25% of the audio of the left channel and 75% of the audio of the right channel.

According to the previous location percentages, it is defined what is emitted from the speakers in the stereophonic system and the results that they will deliver in their different location points are formed, achieving a stereophonic panning of the musical instruments, voices and special effects.

In a stereophonic mix, we would find the following location percentages for the left and right channels:

The left channel of the stereophonic recordings contains the following location percentages in the panning points:

Panning point "A" at 100%
Panning point "D" at 75%
Panning point "C" at 50%
Panning point "E" at 25%
Panning point "B" at 0%

The right channel of stereophonic recordings contains the following location percentages in the panning points:

Panning point "B" at 100%
Panning point "E" at 75%
Panning point "C" at 50%
Panning point "D" at 25%
Panning point "A" at 0%

In FIG. 8, it can be seen the location percentages assigned to each channel.

Taking into account the analysis made to the audio systems, the developers of the present invention assert that none of them makes any mention about the technology of the present application, which focus on the improvement of the stereophonic system using the audio triangular system.

SUMMARY

The present invention presents an audio triangular system based in the structure of panning in the stereophonic mix, said audio triangular system uses 2 input audio channels and 3 output mono audio playback systems, also creates an assignment of panning values to obtain the audio signals corresponding to each one of the three mono audio playback systems, it is important to mention that the interaction of the audio signals obtained from the previous assignment of values causes the triangular effect of the present invention, additionally, the previously mentioned 3 mono audio playback systems must be capable of reproduce a full frequency range of treble, mid and bass tones each one, furthermore, said mono audio playback systems should be located at a certain distance and angles from each other and in relation to the listener.

The audio triangular system is based on the panning structure of music in stereophony to create a triangular effect in a form of semicircle with the stereophonic music or any stereophonic audio.

The audio triangular system comprise of a process of an assignment of values to obtain the audio signals corresponding to each one of the 3 mono audio playback systems, where the audio signal's interaction creates physical and virtual panning points to what we call as the triangular effect of the present invention, also, the audio triangular system comprises of 2 input audio channels and 3 output mono audio playback systems capable to emit a full range of treble, mid and bass frequencies each one so the use of a sub-woofer is unnecessary. The audio triangle system is also characterized because the 3 mono audio playback systems are located at a certain distance and angles from each other and in relation to the listener.

In another embodiment, the audio triangular system further comprises a processor, and a non-transient computer readable medium programmed with computer readable code that upon execution by the processor causes the processor to execute a method of assignment of panning values to obtain the audio signals for each one of the three mono audio playback systems.

In another embodiment, the audio triangular system, comprises also a way to execute the process of assignment of panning values through hardware to obtain the audio signals corresponding to each mono audio playback system.

It is important to mention that said triangular effect of the present invention can be done with the interaction of sound in the acoustic space to create a plurality of physical and virtual panning points, it is important to mention that said audio triangular effect of the present invention can also be executed through hardware with the interaction of signals obtained in the process of assignment of values, both ways to create the audio triangular effect, i.e. through acoustic space and through hardware, will be deeply described later in this document.

DRAWINGS

Figure 16A:
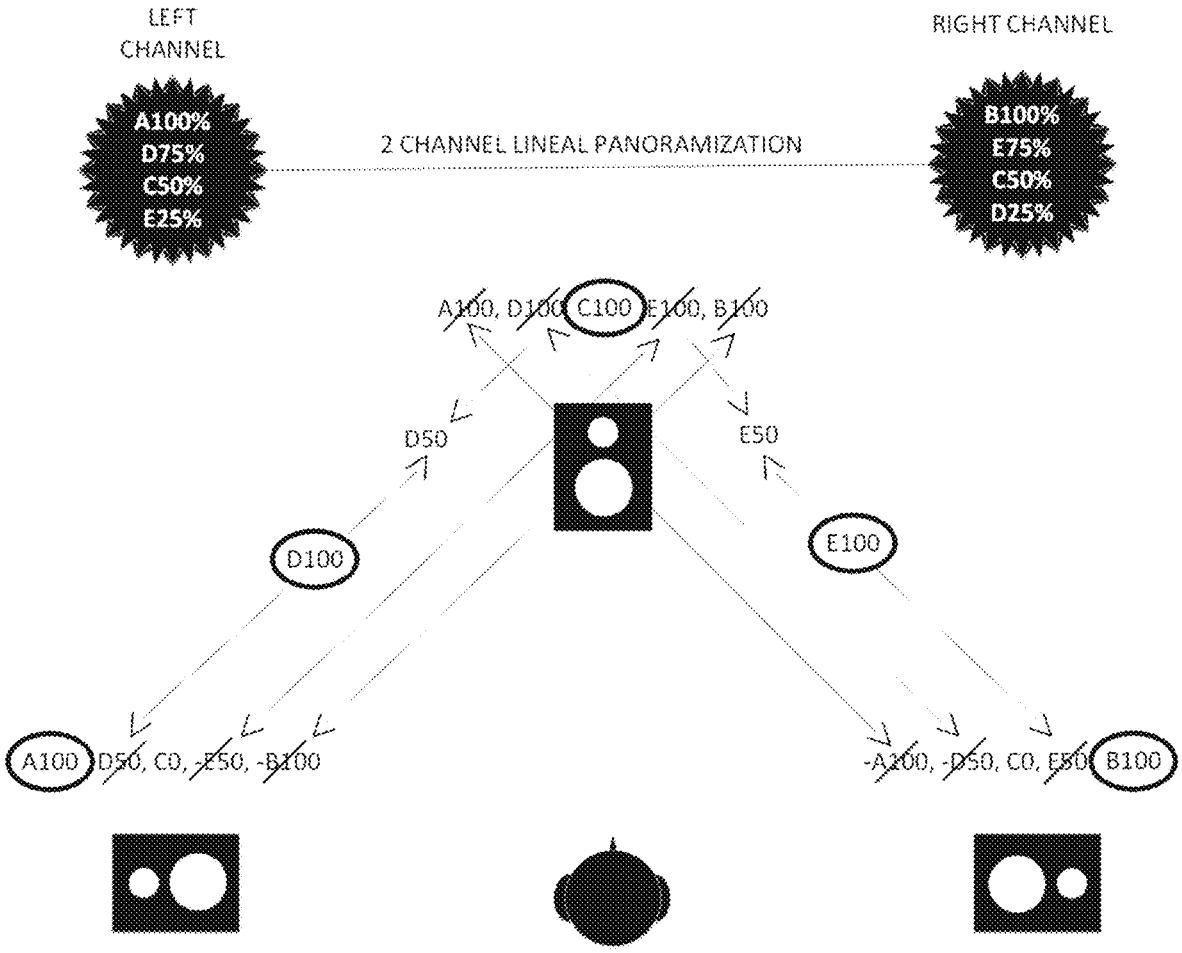

FIG. 16*a* illustrates the process of physical merge of the values for creating the panning points in the $X_2Z_2Y_2$ embodiment created with the technology of the present invention.

Figure 16B:
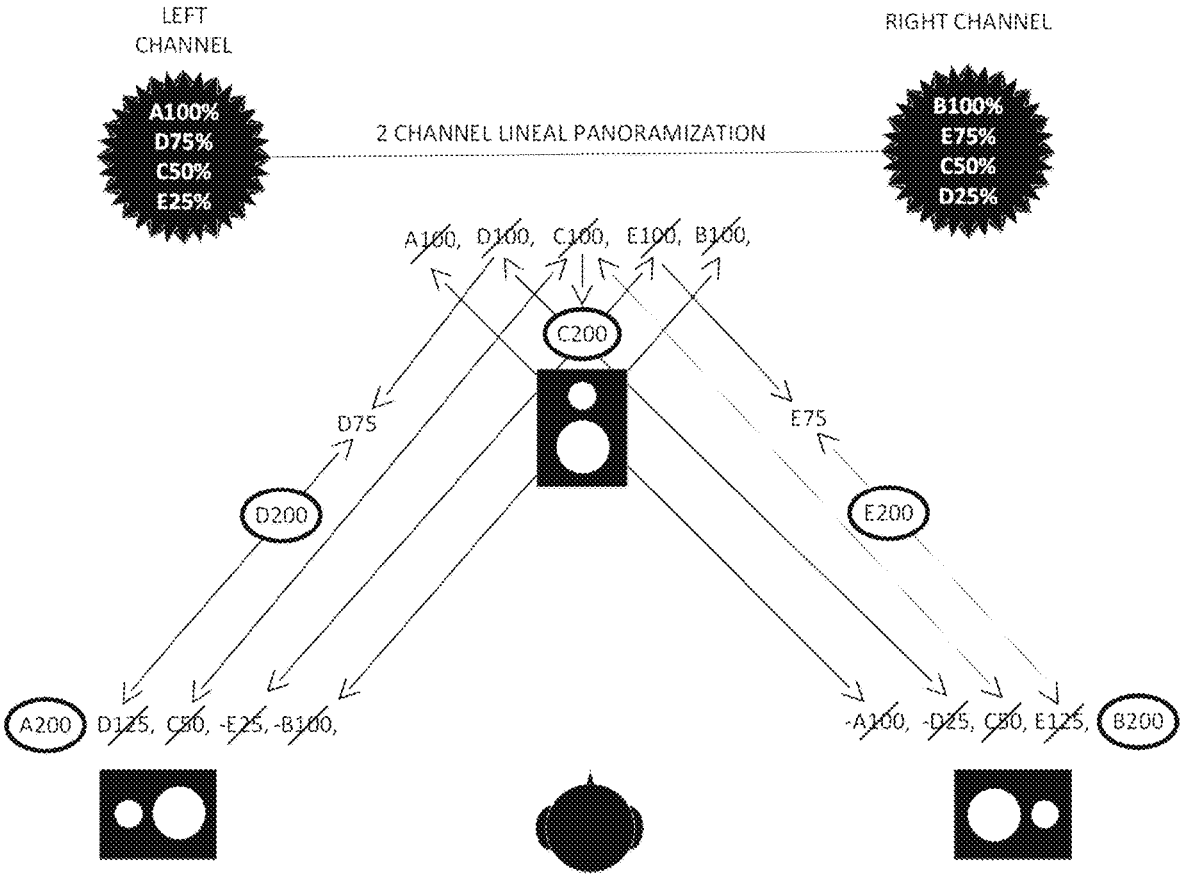

FIG. 16*b* illustrates the process of physical merge of the values for creating the panning points in the $X_3Z_3Y_3$ embodiment created with the technology of the present invention.

FIG. 17 illustrates the mathematical formulas that allow calculate the relationship between the sound levels depending on the distance (r) are shown.

Figure 18:
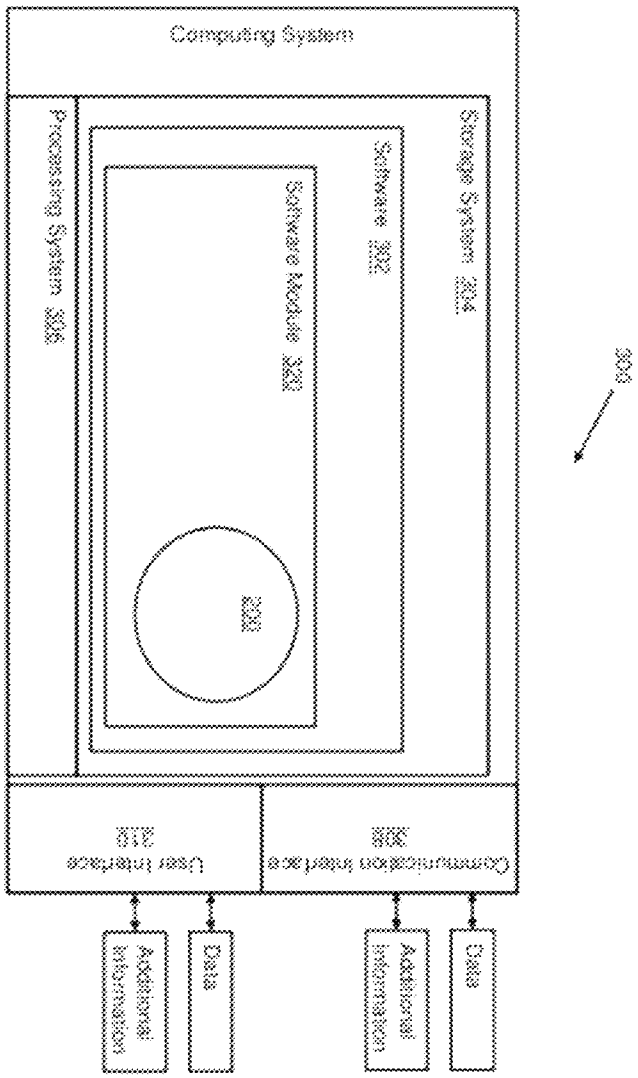

FIG. 18 illustrates a computer system for assigning values for each one of the mono audio playback systems.

Figure 19:
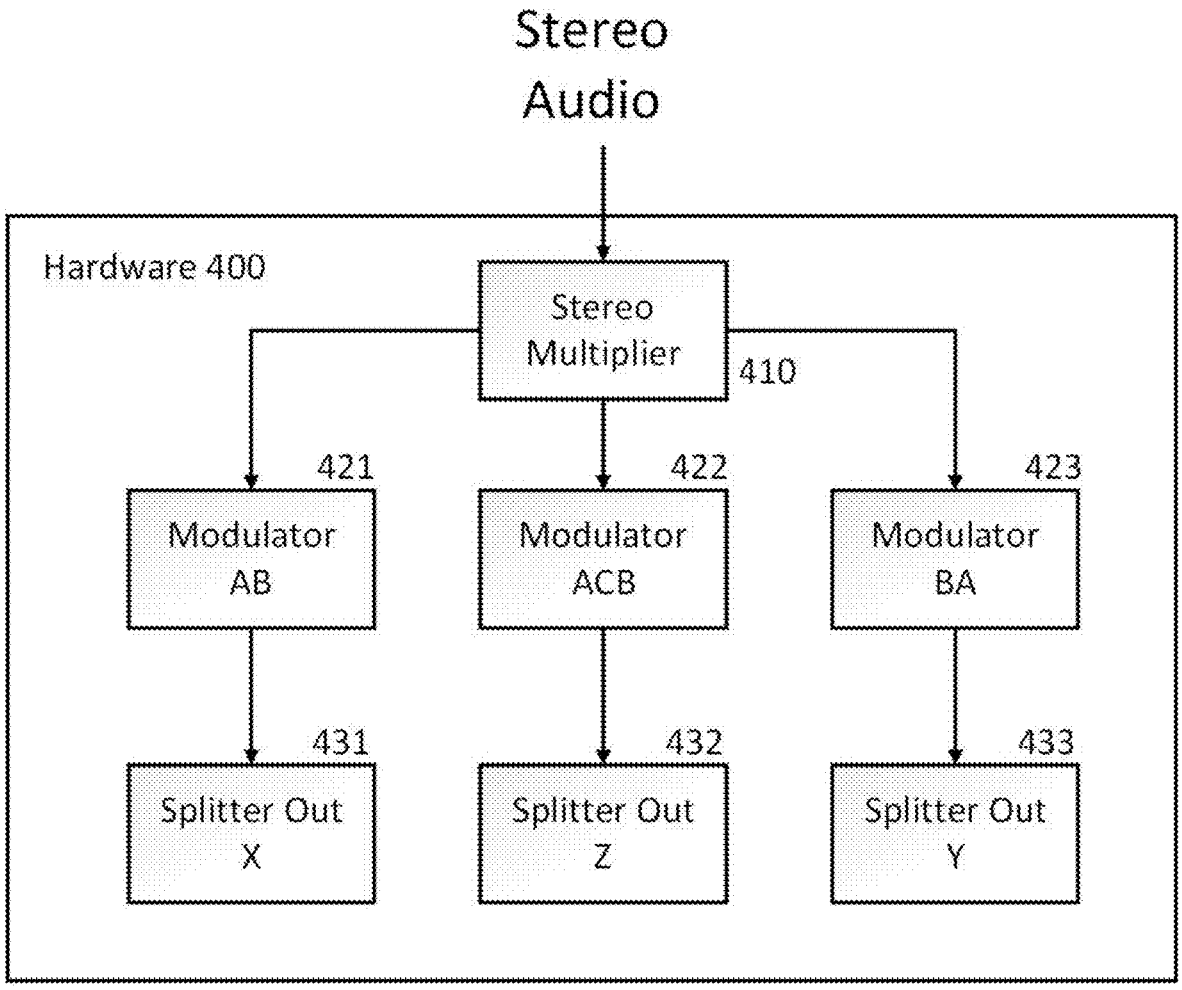

FIG. 19 illustrates a block diagram of an exemplary embodiment of hardware to create the assignment of values for each one of the mono audio playback systems.

Figure 20:
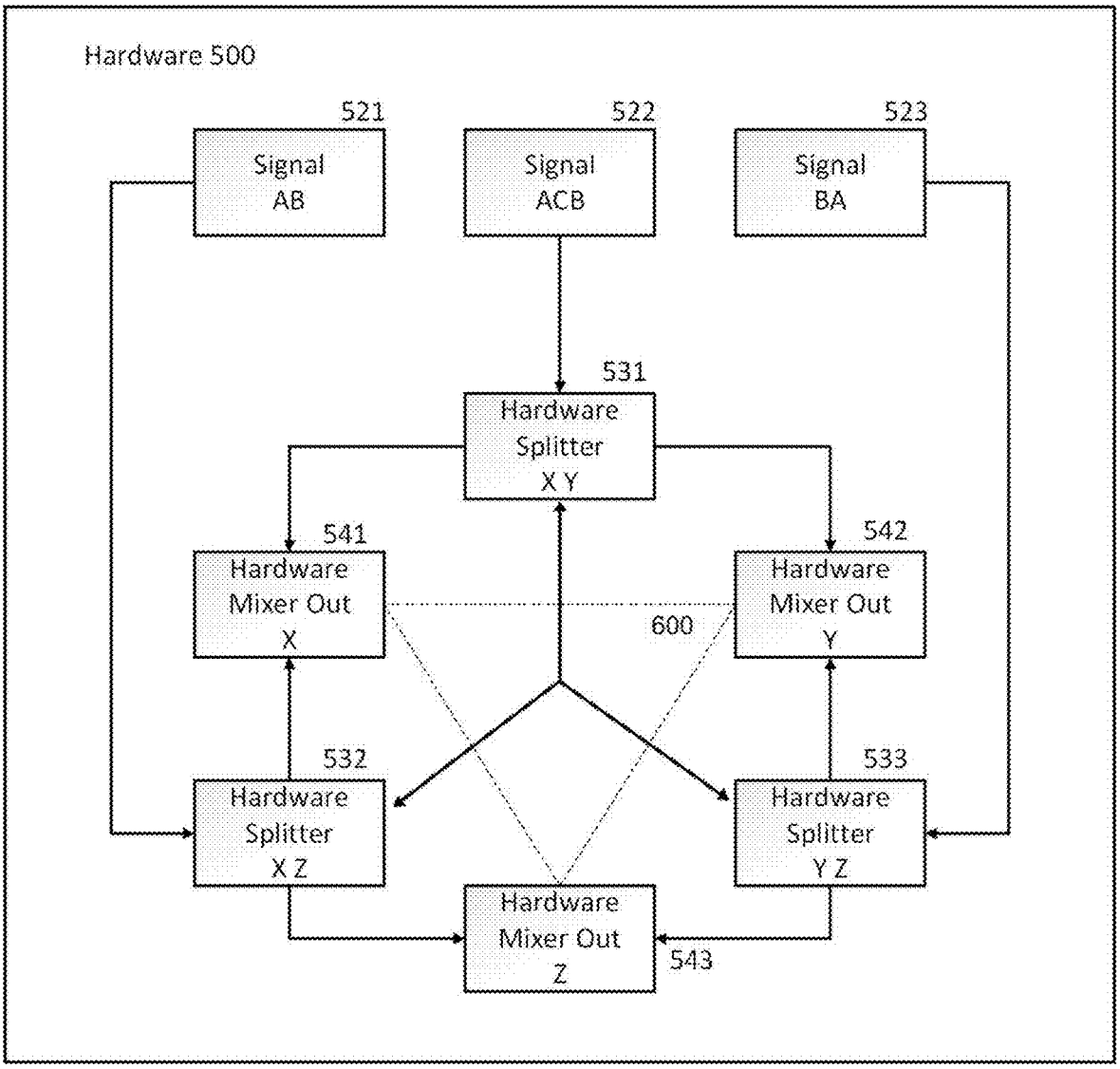

FIG. 20 illustrates a block diagram of an exemplary embodiment to create the audio triangular effect in hardware using the technology of the present invention.

Figure 21A:
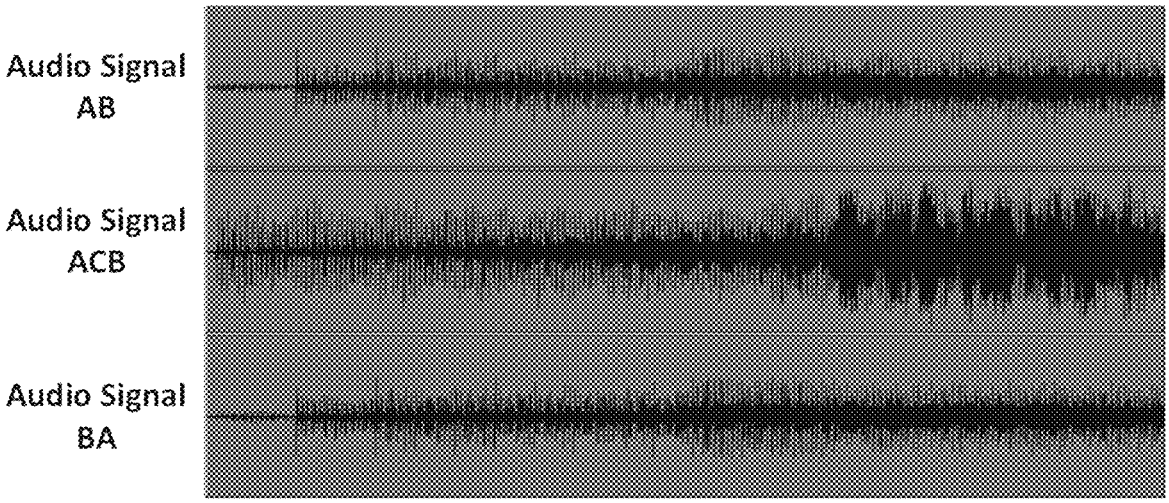

FIG. 21*a* illustrates the graphical audio lines corresponding each of the three mono audio playback systems after the assignment of values in embodiment $X_2$, $Z_2$, $Y_2$ of the present invention.

Figure 21B:
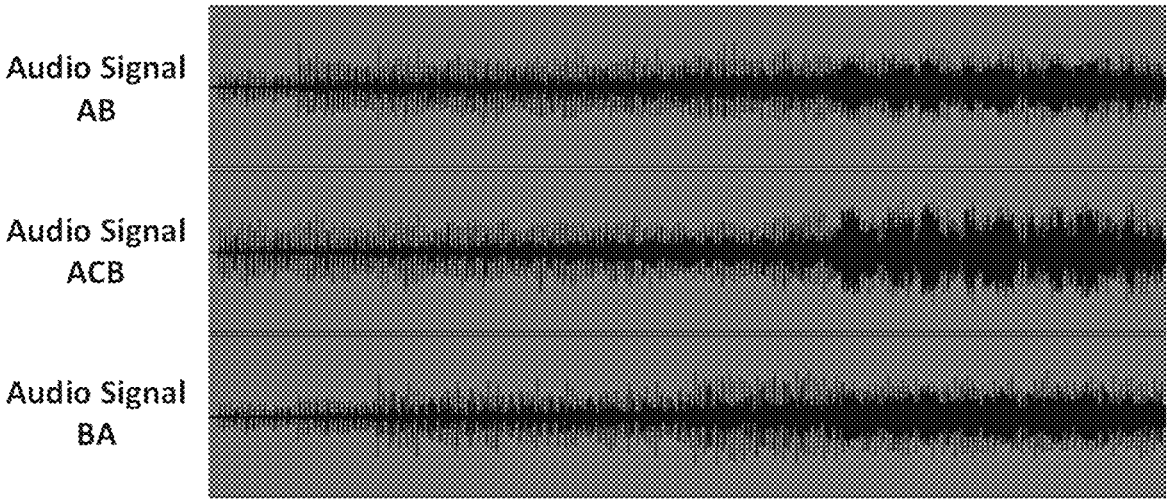

FIG. 21*b* illustrates the graphical audio lines corresponding each of the three mono audio playback systems after the assignment of values in embodiment $X_3$, $Z_3$, $Y_3$ of the present invention.

Figure 22:
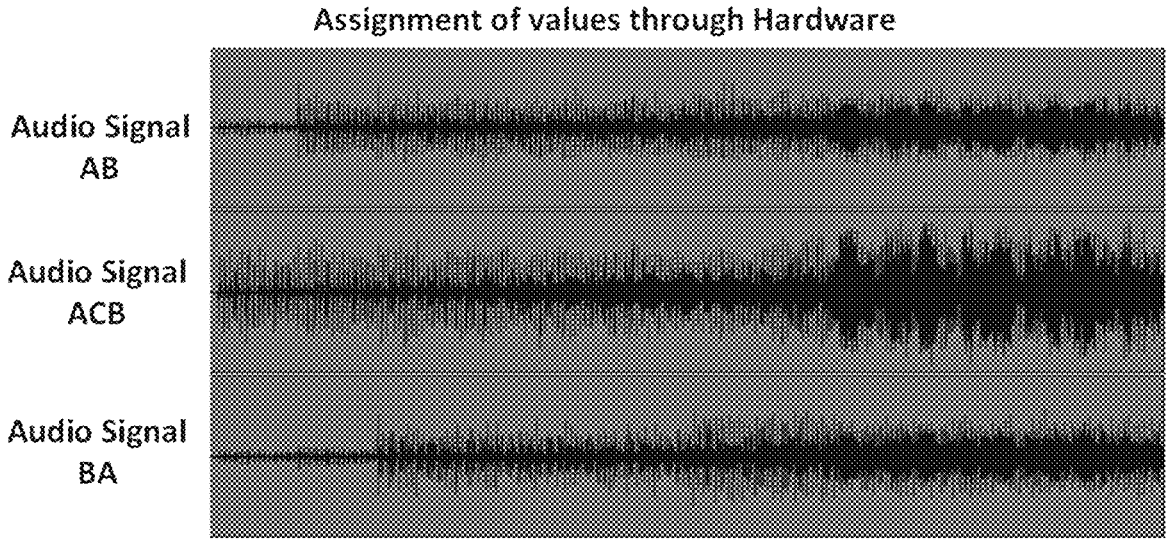

FIG. 22 illustrates the graphical audio lines corresponding each of the three mono audio playback systems after the triangular effect through hardware.

DETAILED DESCRIPTION

The present invention refers to an audio triangular system based in the panning structure of the music in stereophony to create a triangular effect in shape of semicircle with the music or any audio reproduced through the system of the present invention, to which will be named in the present document as "audio triangular system".

The audio triangular system comprises 2 input audio channels and 3 output mono audio playback systems, furthermore the audio triangular system comprises a process of assignment of values to obtain the audio signals corresponding to each one of the 3 mono audio playback systems, where the interaction of the audio signals creates physical and virtual panning points, to what we call as audio triangular effect, therefore, the audio triangular system is characterized because the 3 mono audio playback systems are capable to emit a full range of treble, mid and bass frequencies each one, so the use of a sub-woofer is unnecessary, it is also characterized because said 3 mono audio playback systems are located at a certain distance and angles from each other and in relation to the listener.

Representation of the Physical Location of the Triangular Panning Points

Figure 11:
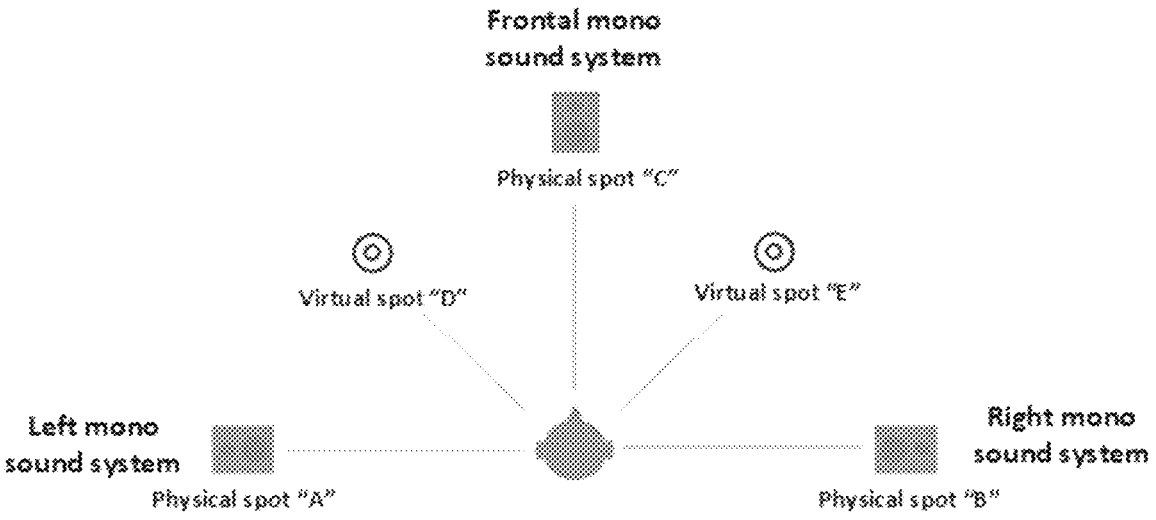
FIG. 11 illustrates the main 5 physical and virtual panning points created with the system of the present invention are shown as reference.

The audio triangular system is applied to 2 input audio channels (stereophonic audio) to be transmitted in 3 output mono audio playback systems, by this way, the audio triangular system is created from 5 to up to "n" panning audio points which are formed by 3 physical points and from 2 up to "n" virtual points. This can be observed in FIG. 11.

In an exemplary, but not limitative embodiment of the present invention, it will be described an audio triangular system 100 that has three physical points named "A", "B" and "C", and two virtual points named "D" and "E"; nevertheless, a person skilled in the art will understand that the audio triangular system 100 can locate an "n" number of virtual panning points in a single atmospheric plane of 180°, creating the sensation of space and body for the sounds and instruments, providing realism and quality for the sound recorded and mixed stereophonically.

It is essential to provide the three mono audio playback systems and that the 3 emit a full range of treble, mid and bass tones. The mono audio playback systems must be of the same size and power and must be calibrated to each other in relation to the volume and frequencies emitted by each one. Therefore, using mono audio playback systems that do not comply with all the above-mentioned parameters will not work for the audio triangular system 100.

Assignment of Panning Values to Obtain the Audio Signals Corresponding to Each One of the Three Mono Audio Playback Systems.

Once the physical representation of the audio triangular system 100 has been mentioned, it is necessary to mention another important aspect of the present invention: the method 200 of selection and assignment of values to obtain the audio signals corresponding to each one of the mono audio playback systems of the audio triangular system 100. The means for carrying out said values selection and assignment are well known by a person skilled in the art; some illustrative, but non-limiting examples of this means are, i.e., software elements such as sequencers, multitrack producer, expanders, phaser modulation, compressor limiters, maximizers, swap channels, surround fuse and commercial plugins, or hardware elements such as sequencers, mono mixer consoles, phase matrix, stereo widener, vocal remove, etc. In an exemplary embodiment, a computer system 300 for selecting and assigning values to obtain the audio signals corresponding to each one of the mono audio playback systems, which will be detailed below, may be included in the audio triangular system 100. Also, in an exemplary embodiment, a hardware system 400 for selecting and assigning values to obtain the audio signals corresponding to each one of the mono audio playback systems, which will be detailed below, may be included in the audio triangular system 100.

In an exemplary embodiment of the present method 200, we create the Assignment of values to obtain the audio signals corresponding to each of the three mono audio playback systems in accordance with the following process, wherein:

A, B, C, D, E=Panning points
L=Left Channel
R=Right Channel
Δ=Audio triangular effect
$\mathfrak{T}$=Merge
$\mathfrak{X}$=Interaction
wherein:
L=(A100/D75/C50/E25)
R=(D25/C50/E75/B100)

Embodiment 1

$Z_2$=Audio signal for the front mono system
$X_2$=Audio signal for the left lateral mono system
$Y_2$=Audio signal for the right lateral mono system Embodiment 2

$Z_3$=Audio signal for the front mono system
$X_3$=Audio signal for the left lateral mono system
$Y_3$=Audio signal for the right lateral mono system Process of Assignment of Panning Values to Obtain the Audio Signals Corresponding to Each One of the Three Mono Audio Playback Systems.

wherein:

$$L \mathfrak{T} R = Z_2$$

$$(A100/D75/C50/E25) \mathfrak{T} (D25/C50/E75/B100) = (A100/D100/C100/E100/B100) = Z_2$$

wherein:

$$R \mathfrak{T} 180° = W$$

$$(D25/C50/E75/B100) \mathfrak{T} 180° = (-D25/-C50/-E75/-B100) = W$$

wherein:

$$W \mathfrak{T} L = X_2$$

$$(-D25/-C50/-E75/-B100) \mathfrak{T} (A100/D75/C50/E25) = (A100/D50/-E50/-B100) = X_2$$

wherein $$X_2 \mathfrak{T} L = X_3$$

$$(A100/D50/-E50/-B100) \mathfrak{T} (A100/D75/C50/E25) = (A200/D125/C50/-E25/-B100) = X_3$$

wherein $$\mathfrak{T}$$

$$L180° = M$$

$$(A100/D75/C50/E25) \mathfrak{T} 180° = (-A100/-D75/-C50/-E25) = M$$

wherein $$M \mathfrak{T} R = Y_2$$

$$(-A100/-D75/-C50/-E25) \mathfrak{T} (D25/C50/E75/B100) = (-A100/-D50/E50/B100) = Y_2$$

wherein $$Y_2 \mathfrak{T} R = Y_3$$

$$(-A100/-D50/E50/B100) \mathfrak{T} (D25/C50/E75/B100) = (-A100/-D25/C50/E125/B200) = Y_3$$

wherein $$X_3 \mathfrak{T} Y_3 = Z_3$$

$$(A200/D125/C50/-E25/-B100) \mathfrak{T} (-A100/-D25/C50/E125/B200) = (A100/D100/C100/E100/B100) = Z_3$$

Explanation of the Process of Assignment of Panning Values to Obtain the Audio Signals Corresponding to Each One of the Three Mono Audio Playback Systems.

wherein:

$$L \mathfrak{T} R = Z_2$$

Left Channel L=(panning point A100%+panning point D75%+panning point C50%+panning point E25%) merged with Right Channel R=(panning point D25%+panning point C50%+panning point E75%+panning point B100%) results in (panning point A100%+panning point D100%+panning point C100%+panning point E100%+panning point B100%) what is named as audio signal for the front mono system=$Z_2$.

wherein:

$$R \mathfrak{T} 180° = W$$

Right Channel R=(panning point D25%+panning point C50%+panning point E75%+panning point B100%) merged at 180° results in =(panning point−D25%+panning point−C50%+panning point−E75%+panning point−B100%) what is named as phase W.

wherein:

$$W \mathfrak{T} L = X_2$$

Phase W=(panning point−D25%+panning point−C50%+panning point−E75%+panning point−B100%) merged with Left Channel L=(panning point A100%+panning point D75%+panning point C50%+panning point E25%) results in =(panning point A100%+panning point D50%+panning point−E50%+panning point−B100%) what is named as audio signal for the left lateral mono system=$X_2$.

Wherein:

$$X_2 \mathfrak{T} L = X_3$$

Audio signal for the left lateral mono system $X_2$=(panning point A100%+panning point D50%+panning point−E50%+panning point−B100%) merged with left channel L=(panning point A100%+panning point D75%+panning point C50%+panning point E25%) results in =(panning point A200%+panning point D125%+panning point C50%+panning point−E25%+panning point−B100%) what is named as audio signal for the left lateral mono system=$X_3$.

wherein $$L \mathfrak{T} 180° = M$$

Left channel L=(panning point A100%+panning point D75%+panning point C50%+panning point E25%) merged at 180° results in =(panning point−A100%+panning point−D75%+panning point−C50%+panning point−E25%) what is named as phase M.

wherein $$M \mathfrak{T} R = Y_2$$

Phase M=(panning point−A100%+panning point−D75%+panning point−C50%+panning point−E25%) merged with right channel R=(panning point D25%+panning point C50%+panning point E75%+panning point B100%) results in =(panning point−A100%+panning point−D50%+panning point E50%+panning point B100%) what is named as audio signal for the right lateral mono system=$Y_2$ wherein $$Y_2 \mathfrak{T} R = Y_3$$

Audio Signal for the right lateral mono system $Y_2$=(panning point−A100%+panning point−D50%+panning point E50%+panning point B100%) merged with right channel R=(panning point D25%+panning point C50%+panning point E75%+panning point B100%) results in =(panning point−A100%+panning point−D25%+panning point C50%+panning point E125%+panning point B200%) what is named as audio signal for the right lateral mono system=$Y_3$ wherein $$X_3 \mathfrak{T} Y_3 = Z_3$$

Audio signal for the left lateral mono system $X_3$=(panning point A200%+panning point D125%+panning point C50%+panning point−E25%+panning point−B100%) merged with audio signal for the right lateral mono system $Y_3$=(panning point−A100%+panning point−D25%+panning point C50%+panning point E125%+panning point B200%) results in =(panning point A100%+panning point D100%+panning point C100%+panning point E100%+panning point B100%) what is named as audio signal for the front mono system=$Z_3$ It is important to mention that said process of assignment of values described before, can be done through software of through hardware, both embodiments will be explained later in this document.

Audio Triangular Effect of the Present Invention for its Two Embodiments: Embodiment $X_2$, $Z_2$, $Y_2$ and Embodiment $X_3$, $Z_3$, $Y_3$

Explanation of the Audio Triangular Effect in Embodiment $X_2Z_2Y_2$

Figure 12:
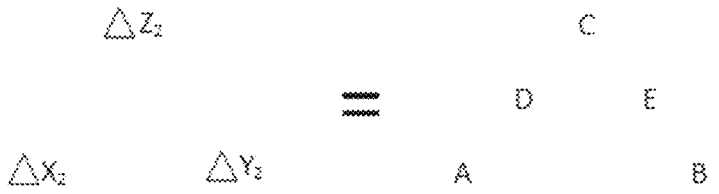
FIG. 12 illustrates the relationship between the audio signals $X_2$, $Z_2$ and $Y_2$ with the panning points A, D, C, E, B in the physical space is shown as reference.

The interaction of the audio signals $X_2$, $Z_2$ and $Y_2$ causes the triangular effect in each one of the mono audio playback systems, which results in the appreciation of the panning points A, D, C, E, B in the boundaries of the formed triangle, as it is represented in the FIG. 12.

wherein:

$$X_2 \mathfrak{X} Z_2 = \Delta X_2 = AD$$

$$Y_2 \mathfrak{X} Z_2 = \Delta Y_2 = BE$$

$$Z_2 \mathfrak{X} X_2 \mathfrak{X} Y_2 = \Delta Z_2 = CDE$$

wherein:

The audio signal for the left lateral mono system $X_2$ in interaction with the audio signal for the front mono system $Z_2$ results in the triangular effect $\Delta X_2$ for creating the panning points "AD".

wherein:

The audio signal for the right lateral mono system $Y_2$ in interaction with the audio signal for the front mono system $Z_2$ results in the triangular effect $\Delta Y_2$ for creating the panning points "BE".

wherein:

The audio signal for the left lateral mono system $X_2$ in interaction with the audio signal for the front mono system $Z_2$ and at the same time the audio signal for the right lateral mono system $Y_2$ in interaction with the audio signal for the front mono audio system $Z_2$ results in the triangular effect $\Delta Z_2$ for creating the panning points "CDE".

wherein:

$$(A100/D50/\overset{X_2}{-E50}/-B100)\mathbin{\rotatebox{90}{$\mathrm{X}$}}(A100/D100/\overset{Z_2}{C100}/E100/B100)$$
$$\mathbin{\rotatebox{90}{$\mathrm{X}$}}(-A100/-\overset{Y_2}{D50}/E50/B100)$$
$$=(\overset{\Delta X_2}{A100/D50})(D50/\overset{\Delta Z_2}{C100}/E50)(\overset{\Delta Y_2}{E50/B100})$$

wherein:

The audio signal for the left lateral mono system $X_2$=(panning point A100%+panning point D50%+panning point−E50%+panning point−B100%) in interaction with the audio signal for the front mono system $Z_2$=(panning point A100%+panning point D100%+panning point C100%+panning point E100%+panning point B100%) in interaction with the audio signal right lateral mono system $Y_2$=(panning point−A100%+panning point−D50%+panning point E50%+panning point B100%) results in the triangular effects:

Triangular effect $\Delta X_2$=(panning point $A$100%+panning point $D$50%)

Triangular effect $\Delta Z_2$=(panning point $D$50%+panning point $C$100%+panning point $E$50%)

Triangular effect $\Delta Y_2$=(panning point $E$50%+panning point $B$100%)

Explanation of the Audio Triangular Effect in Embodiment $X_3Z_3Y_3$

Figure 13:
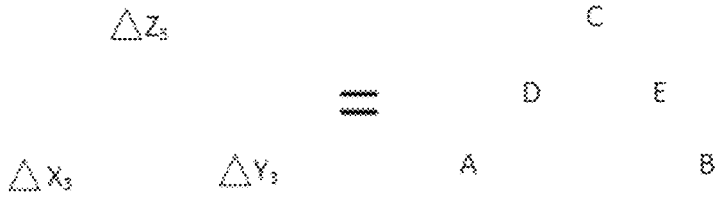
FIG. 13 illustrates the relationship between the audio signals $X_3$, $Z_3$ and $Y_3$ with the panning points in the physical space is shown as reference.

The interaction of the audio signals $X_3$, $Z_3$ and $Y_3$ causes that the triangular effect in each one of the mono audio systems, which results in the appreciation of the panning points A, D, C, E, B in the boundaries of the formed triangle, as it is represented in the FIG. 13.

Wherein:

$$X_3 \mathbin{\rotatebox{90}{$\mathrm{X}$}} Z_3=\Delta X_3=AD$$

$$Y_3 \mathbin{\rotatebox{90}{$\mathrm{X}$}} Z_3=\Delta Y_3=BE$$

$$Z_3 \mathbin{\rotatebox{90}{$\mathrm{X}$}} X_3 \mathbin{\rotatebox{90}{$\mathrm{X}$}} Y_3=\Delta Z_3=CDE$$

wherein:

The audio signal for the left lateral mono system $X_3$ in interaction with the audio signal for the front mono system $Z_3$, results in the triangular effect $\Delta X_3$ creating the panning points "AD".

wherein

The audio signal for the right lateral mono system $Y_3$ in interaction with the audio signal for the front mono system $Z_3$ results in the triangular effect $\Delta Y_3$ for creating the panning points "BE".

wherein:

The audio signal for the left lateral mono system $X_3$ in interaction with the audio signal for the front mono system $Z_3$ and at the same time the audio signal for the right lateral mono system $Y_3$ in interaction with the audio signal for the front mono audio system $Z_3$ results in the triangular effect $\Delta Z_3$ for creating the panning points "CDE".

wherein $$(A200/D125/\overset{X_3}{C50}/-E25/-B100)\mathbin{\rotatebox{90}{$\mathrm{X}$}}(A100/D100/\overset{Z_3}{C100}/E100/B100)$$
$$\mathbin{\rotatebox{90}{$\mathrm{X}$}}(-A100/-\overset{Y_3}{D25}/C50/E125/B200)$$
$$=(\overset{\Delta X_3}{A200/D125})(D75/\overset{\Delta Z_3}{C200}/E75)(\overset{\Delta Y_3}{E125/B200})$$

wherein

The audio signal for the left mono lateral system $X_3$=(panning point A200%+panning point D125%+panning point C50%+panning point−E25%+panning point−B100%) in interaction with the audio signal for the front mono system $Z_3$=(panning point A100%+panning point D100%+panning point C100%+panning point E100%+panning point B100%) in interaction with audio signal for the right lateral mono system $Y_3$=(panning point−A100%+panning point−D25%+panning point C50%+panning point E125%+panning point B200%) results in the triangular effects:

Triangular effect $\Delta X_3$=(panning point $A$200%+panning point $D$125%)

Triangular effect $\Delta Z_3$=(panning point $D$75%+panning point $C$200%+panning point $E$75%)

Triangular effect $\Delta Y_3$=(panning point $E$125%+panning point $B$200%)

Figure 14:
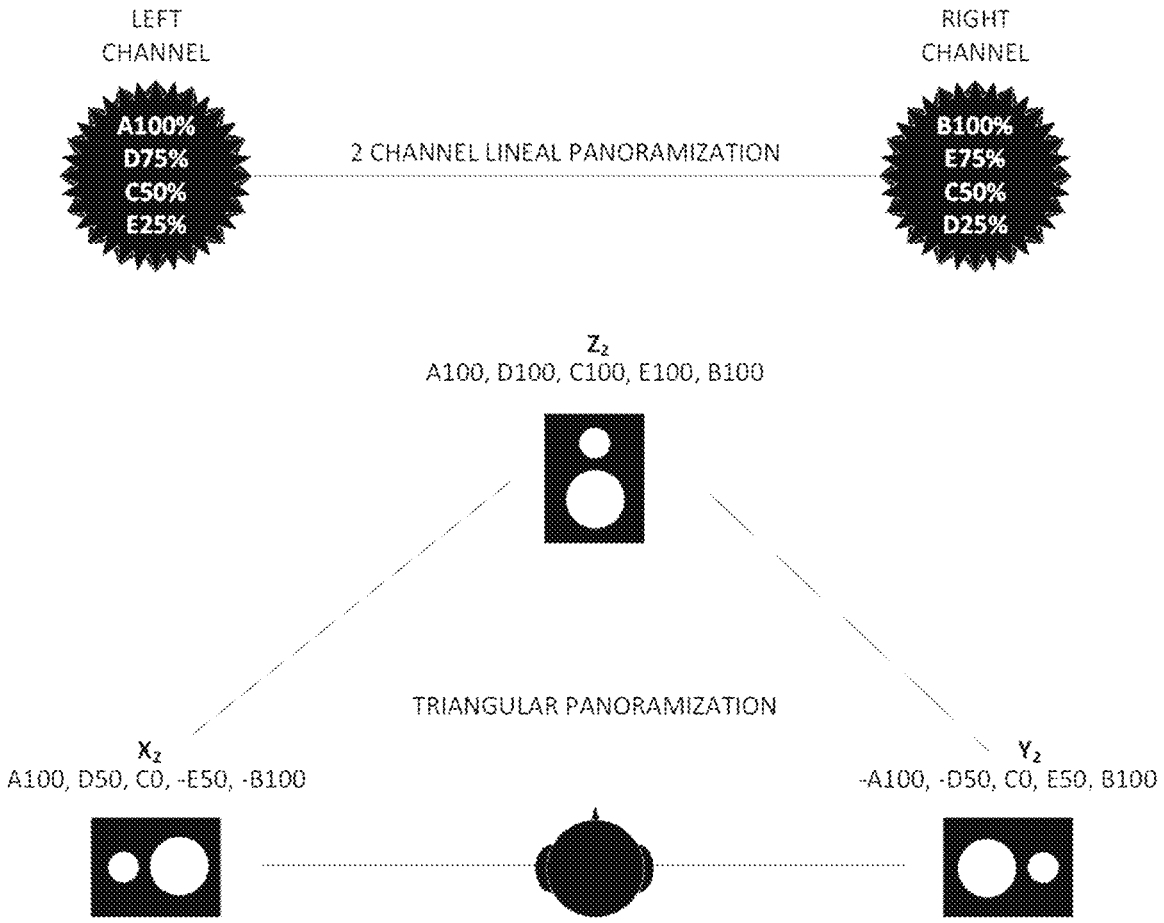
FIG. 14 illustrates the comparison of a linear stereophonic panning with the triangular panning provided by the present invention in the $X_2Z_2Y_2$ embodiment of the present invention is shown as a reference.
Figure 15:
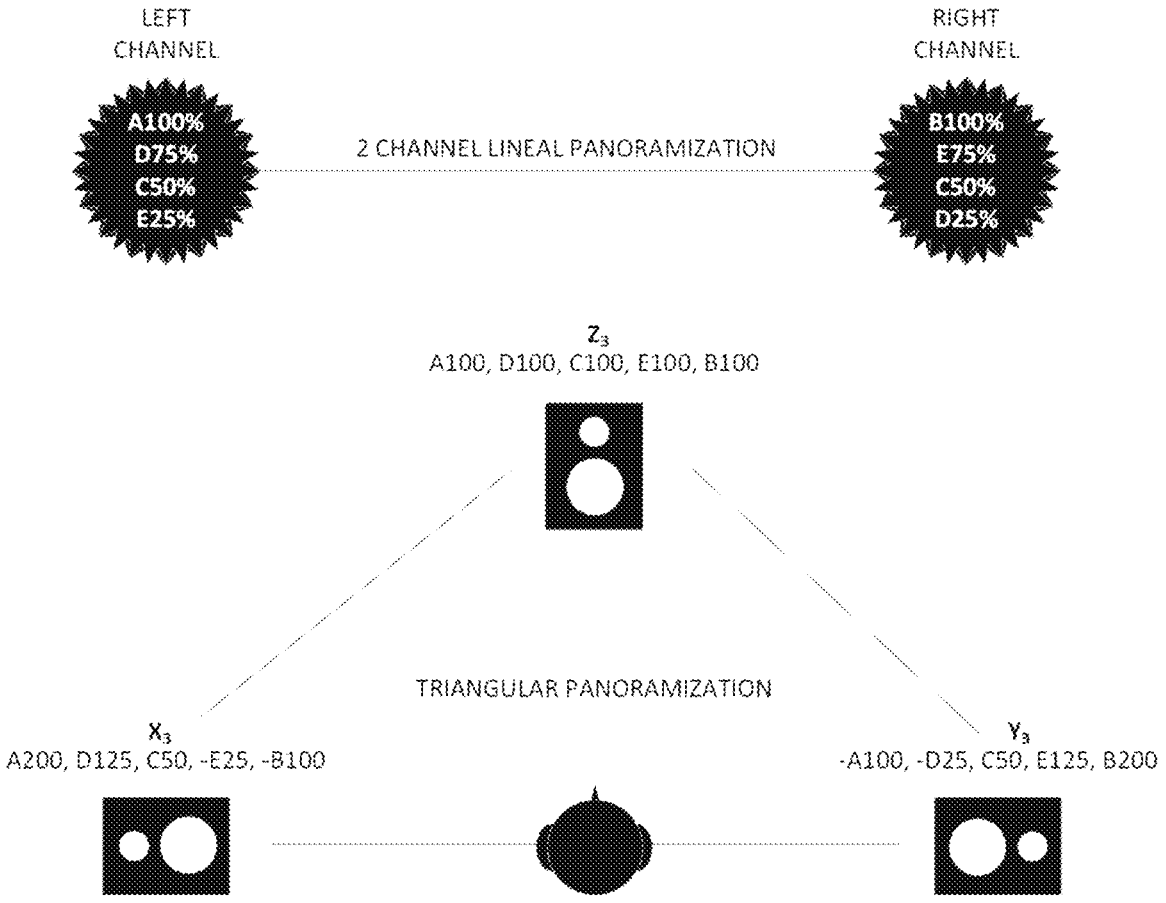
FIG. 15 illustrates the comparison of a linear stereophonic panning with the triangular panning provided by the present invention in the $X_3Z_3Y_3$ embodiment of the present invention is shown as a reference.

In the FIGS. 14 and 15, it is shown the representation of the values applied to the mono audio playback systems in its two embodiments, respectively.

It is important to mention that said triangular effect described before can be done through the acoustic space and also can be done through hardware, both embodiments will be explained later in this document.

The reason why we do said assignment of values is unique and precise, as it allows placing the panning points corresponding to each mono audio playback system in the indicated position, also with the interaction of audio signals we generate the audio triangular effect of the present invention. If the assignment of values and the interaction of audio signals are not carried out properly, the audio triangular system 100 cannot be effective, so that what is described above as the assignment of values and audio triangular effect are essential for this invention.

Assignment of Panning Values Through Software

It is important to mention that the Process of Assignment of values to obtain the audio signals corresponding to each one of the three mono audio playback systems described before, can be made through software and it can be applied to both embodiments $X_2$ $Z_2$ $Y_2$ and $X_3$ $Z_3$ $Y_3$ of the present invention. In an exemplary but not limitative manner, the necessary elements to carry out said process of assigning values through software are shown.

FIG. 18 illustrates a block diagram of an exemplary embodiment of a computing system 300 for assigning values to obtain the audio signals corresponding to each one of the mono audio playback systems. The computing system 300 may be used to implement embodiments of portions of the audio triangular system 100, or in carrying out embodiments of the method 200.

The computing system 300 is generally a computing system that includes a processing system 306, a storage system 304, software 302, a communication interface 308, and a user interface 310. The processing system 306 loads and executes software 302 from the storage system 304, including a software module 320. When executed by computing system 300, software module 320 directs the processing system 306 to operate as described in herein in further detail in accordance with the above method 200.

The computing system 300 includes a software module 320 for executing method 200. Although computing system 300 as depicted in FIG. 18 includes one software module 320 in the present example, it should be understood that more modules could provide the same operation. Similarly, while the description as provided herein refers to a computing system 300 and a processing system 306, it is to be recognized that implementations of such systems can be performed using one or more processors, which may be communicatively connected, and such implementations are considered to be within the scope of the description. It is also contemplated that these components of computing system 300 may be operating in a number of physical locations.

The processing system 306 can comprise a microprocessor and other circuitry that retrieves and executes software 302 from storage system 304. The processing system 306 can be implemented within a single processing device but can also be distributed across multiple processing devices or sub-systems that cooperate in existing program instructions. Non-limiting examples of processing systems 306 include general purpose central processing units, application specific processors, and logic devices, as well as any other type of processing device, combinations of processing devices, or variations thereof.

The storage system 304 can comprise any storage media readable by processing system 306, and capable of storing software 302. The storage system 304 can include volatile and non-volatile, removable and non-removable media implemented in any method or technology for storage of information, such as computer readable instructions, data structures, program modules, or other information. The storage system 304 can be implemented as a single storage device but may also be implemented across multiple storage devices or sub-systems. The storage system 304 can further include additional elements, such a controller capable of communicating with the processing system 306.

Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system, as well as any combination or variation thereof, or any other type of storage medium. In some implementations, the storage media can be a non-transitory storage media. In some implementations, at least a portion of the storage media may be transitory. Storage media may be internal or external to computing system 300.

As described in further detail herein, computing system 300 receives and transmits data through communication interface 308, particularly values for the stereophonic panning points which may be transmitted to the three mono audio playback output systems. The data can also include any of the above data used to set up or modify system 100, any calculated quantities or levels, and/or any other data that may pertain to system 100. In embodiments, the communication interface 308 also operates to send and/or receive information, such as, but not limited to, additional information to/from other systems to which computing system 300 is communicatively connected, input related to derived and/or calculated data, and/or any additional information that may pertain to system 100.

The user interface 310 can include one or more of a mouse, a keyboard, a voice input device, a touch input device for receiving a gesture from a user, a motion input device for detecting non-touch gestures and other motions by a user, and/or other comparable input devices and associated processing elements capable of receiving user input from a user. Output devices such as a video display or graphical display can display one or more of the selectable embodiments, values for the stereophonic panning points, or another interface further associated with embodiments of the system and method as disclosed herein. Speakers, printers, haptic devices and other types of output devices may also be included in the user interface 310. Users or other staff can communicate with computing system 300 through the user interface 310 in order to view derived and/or calculated data, to enter or receive any other data or additional information, or any number of other tasks the user may want to complete with computing system 300.

Assignment of Panning Values Through Hardware

It is important to mention that the Process of Assignment of values to obtain the audio signals corresponding to each one of the three mono audio playback systems described before, can also be made through hardware and it can be applied to both embodiments $X_2$ $Z_2$ $Y_2$ and $X_3$ $Z_3$ $Y_3$ of the present invention. In an exemplary but not limitative manner, the necessary elements to carry out said process of assigning values through hardware are shown.

The FIG. 19 illustrate a block diagram representing an exemplary embodiment of a hardware system 400 for assigning values to obtain the audio signal corresponding to each one of the three mono audio playback systems.

The hardware system 400 includes and uses a hardware audio multiplier 410, at least a first audio modulator hardware 421, at least a second audio modulator hardware 422, at least a third audio modulator hardware 423, at least a first audio splitter out hardware 431, at least a second audio splitter out hardware 432, at least a third audio splitter out hardware 433.

The audio multiplier hardware 410 receives a stereophonic audio signal and replicate said signal in order to send the same to each one of the at least three audio modulators hardware 421, 422 and 423.

The first audio modulator hardware 421 modulates the stereophonic audio signal received by the same in order to convert said signal into a first modulated audio signal Aft the second audio modulator hardware 422 modulates the stereophonic audio signal received by the same in order to convert said signal into a second modulated audio signal ACB, the third audio modulator hardware 423 modulates the stereophonic audio signal received by the same in order to convert said signal into a third modulated audio signal BA.

The first audio modulator hardware 421 send the first modulated audio signal AB to the first audio splitter out hardware 431, which divides the audio signal received in order to convert said signal into a new audio signal X to reproduce the same in its corresponding left mono audio playback system.

The second audio modulator hardware 422 send the second modulated audio signal ACB to the second audio splitter out hardware 432, which divides the audio signal received by the same in order to convert said signal into a new audio signal Z to reproduce the same in its corresponding front central mono audio playback system.

The third audio modulator hardware 423 send the third modulated audio signal BA to the third audio splitter out hardware 433, which divides the audio signal received by the same in order to convert said signal into a new audio signal Y to reproduce the same in its corresponding right mono audio playback system.

It is important to mention that the principal objective of said process to create the assignment of values through hardware is to obtain the audio signals X, Z and Y for any of the both embodiments $X_2$, $Z_2$, $Y_2$ and embodiment $X_3$, $Z_3$, $Y_3$, those audio signals correspond to each one of the three mono audio playback systems of the present invention.

To illustrate the result of the audio signals obtained from the assignment of values described above, the following graphic captures of the audio lines of both modalities were made.

The FIGS. 21*a* and 21*b* illustrate a graphic representation that show graphic results for both embodiments $X_2$, $Z_2$, $Y_2$ and $X_3$, $Z_3$, $Y_3$ after the realization of the previous said assignment of values to obtain the audio signal corresponding to each one of the three mono audio playback systems, therefore, the FIGS. 21*a* and 21*b* allow us to appreciate the graphic representation of the audio signal of each channel out to see the differences obtained between both embodiments of the present invention: embodiment $X_2$, $Z_2$, $Y_2$ and $X_3$, $Z_3$, $Y_3$. It is important to mention that said assignment of values to obtain the audio signals for each one of the mono audio playback systems for each one of the two embodiments could have been done through software or through hardware as described before in this document.

Triangular Effect Through the Acoustic Space

It is important to mention that the triangular audio effect of the present invention described before can be done in the acoustic space of the listener, this means that it occurs during the appreciation of the sound being reproduced by the triangular audio system, said triangular effect in the acoustic space works for both embodiments $X_2Z_2Y_2$ and embodiment $X_3Z_3Y_3$ of the present invention, in addition, it is just as effective if the previous assignment of values was made through software or hardware. In an exemplary but no limitative manner, the interaction of the values of the audio signals coming out of each mono audio playback system in the acoustic space is shown to achieve the triangular audio effect.

The front central mono audio playback system interacts with both the left lateral mono audio playback system and the right lateral mono audio playback system, but the lateral mono systems never interact with each other, this is because the distance between them is almost twice the distance that they have with the front central mono system, this is very important, because if they do not meet the required distance, the interaction of the values of the audio signals coming out of each one of the mono audio playback system will not be made in the physical space correctly, and the body and panning of the sound cannot be created.

The interaction process of the values of the audio signals coming out of each one of the mono audio playback systems makes that the negatives of each letter interact with the positives of the same letter, resulting in the five main points of panning obtained in the following way:

Interaction of the Values of the Audio Signals Coming Out of Each One of the Three Mono Audio Playback Systems to Create the Triangular Effect in Both Embodiments.

The elimination in the triangular physical space occurs with the interaction of panning percentages between the lateral mono audio playback systems with central mono audio playback systems, starting with the elimination of negative percentages with the positives as shown in FIGS. 16*a* and 16*b* that can be used as reference in the explanation of the following two embodiments.

Explanation of Embodiment $X_2$, $Z_2$, $Y_2$

The −B100 value of the left lateral mono audio playback system is eliminated by interacting with the B100 of the front central mono audio playback system, eliminating completely both values for both mono audio playback systems in the triangular audio space.

The −A100 value of the right lateral mono audio playback system eliminates the A100 value of the front central mono audio playback system, eliminating completely both values for both mono audio playback systems in the triangular audio space.

The −E50 value of the left lateral mono audio playback system is eliminated by interacting with the E100 of the front central mono audio playback system, leaving a new value for the front central mono audio playback system E50. This new E50 value can now interact with the E50 value of the right lateral mono audio playback system, as being the result of a previous interaction, the positives can be added throwing the new virtual audio point with its new E100 value in the triangular audio space.

The −D50 value of the right lateral mono audio playback system is eliminated by interacting with the D100 of the front central mono audio playback system, leaving a new value for the front central mono audio playback system D50. This new D50 value can now interact with the D50 value of the left lateral mono audio playback system, as being the result of a previous interaction, the positives can be added throwing the new virtual audio point with its new D100 value in the triangular audio space.

The C0 value of the left lateral mono audio playback system cannot interact with the front central mono audio playback system because its value is 0.

The C0 value of the right lateral mono audio playback system cannot interact with the front central mono audio playback system because its value is 0.

The A100 value of the left lateral mono audio playback system cannot eliminate any value from the front central mono audio playback system since the A100 contained by the front central mono audio playback system has already been previously eliminated. Now the only point that will contain the A100 value will be the left lateral mono audio playback system in the triangular audio space.

The B100 value of the right lateral mono audio playback system cannot eliminate any value from the front central mono audio playback system since the B100 contained by the front central mono audio playback system has already been previously eliminated. Now the only point that will contain the B100 value is the right lateral mono audio playback system in the triangular audio space.

After the interaction of both lateral mono audio playback systems with the front central mono audio playback system, the only point where the C100 value is located is in the front central mono audio playback system in the triangular audio space.

Explanation of Embodiment $X_3$, $Z_3$, $Y_3$

The −B100 value of the left lateral mono audio playback system is eliminated by interacting with the B100 of the front central mono audio playback system, eliminating completely both values for both mono audio playback systems in the triangular audio space.

The –A100 value of the right lateral mono audio playback system eliminates the A100 value of the front central mono audio playback system, eliminating completely both values for both mono audio playback systems in the triangular audio space.

The –E25 value of the left lateral mono audio playback system is eliminated by interacting with the E100 of the front central mono audio playback system, leaving a new value for the front central mono audio playback system E75. This new E75 value can now interact with the E125 value of the right lateral mono audio playback system, as being the result of a previous interaction, the positives can be added throwing the new virtual audio point with its new E200 value in the triangular audio space.

The –D25 value of the right lateral mono audio playback system is eliminated by interacting with the D100 of the font central mono audio playback system, leaving a new value for the front central mono audio playback system D75. This new D75 value can now interact with the D125 value of the left lateral mono audio playback system, as being the result of a previous interaction, the positives can be added throwing the new virtual audio point with its new D200 value in the triangular audio space.

The C50 value of the left lateral mono audio playback system interact with the C100 value of the front central mono audio playback system and at the same time the C50 value of the right lateral mono audio playback system interact with the C100 value of the front central mono audio playback system creating a new C200 value for the front central mono audio playback system.

The A200 value of the left lateral mono audio playback system cannot eliminate any value from the front central mono audio playback system since the A100 contained by the front central mono audio playback system has already been previously eliminated. Now the only point that will contain the A200 value will be the left lateral mono audio playback system in the triangular audio space.

The B200 value of the right lateral mono audio playback system cannot eliminate any value from the front central mono audio playback system since the B100 contained by the front central mono audio playback system has already been previously eliminated. Now the only point that will contain the B200 value is the right lateral mono audio playback system in the triangular audio space.

By complementing audio signal of the Left mono audio playback system with the audio signal of the frontal central mono audio playback system and at the same time, complementing the audio signal of the right mono audio playback system with the audio signal of the frontal central mono audio playback system for both embodiments above described, it can be obtained 100% of each of the panning points "A" "D" "C" "E" "B" in a new triangular panning. This way obtains the higher value of each panning point, regardless of the number of virtual points that the user wishes to create.

By carrying out the values assignment previously described above and thanks to the interaction of the values themselves, the system is able to create a complete spatial atmosphere of sounds with their own body and depth, granting the ability of approaching the "n" number of panning points at 100%.

Triangular Effect Through Hardware

It is important to mention that the triangular audio effect of the present invention previously described can also be done through hardware and for both embodiments $X_2Z_2Y_2$ and $X_3Z_3Y_3$, in addition, it is equally effective if the previous assignment of values was made through software or hardware. In an exemplary but not limitative manner, the necessary elements to create the triangular audio effect through hardware are shown.

The FIG. 20 illustrates a block diagram of an exemplary embodiment to accomplish the triangular audio effect 600 of the present invention through the hardware system 500.

The hardware system 500 includes and uses at least one of the first audio splitter hardware 531, at least a second audio splitter hardware 532, at least a third audio splitter hardware 533, at least one of the first audio mixer out hardware 541, at least a second audio mixer out hardware 542 and at least a third audio mixer out hardware 543.

The first audio splitter hardware 531 receives the audio signal ACB obtained from the previous assignment of values, splits said audio signal and convert it into a new audio signal XY, the second audio splitter hardware 532 receives the audio signal AB obtained from the previous assignment of values, splits said audio signal and convert it into a new audio signal XZ, the third audio splitter hardware 533 receives the audio signal BA obtained from the previous assignment of values, splits said audio signal and convert it into a new audio signal YZ.

It is important to mention that said previous assignment of values could have been done through software or through hardware, both methods have been described above in this document.

It is important to mention that each one of the at least three audio splitter hardware 531,532 and 533 are interconnected to each other internally.

The first mixer out of audio hardware 541 receives the audio signals from the first audio splitter hardware 531 and the second audio splitter hardware 532 to generate a new audio signal X, which will be reproduced by its corresponding left mono audio playback system.

The second mixer out of audio hardware 542 receives the audio signals from the first audio splitter hardware 531 and from the third audio splitter hardware 533 to generate a new audio signal Y, which will be reproduced by its corresponding right mono audio playback system.

The third mixer out of audio hardware 543 receives the audio signals from the second audio splitter hardware 532 and from the third audio splitter hardware 533 to generate a new audio signal Z, which will be played/reproduced by its corresponding front central mono audio playback system.

To illustrate the result of the audio signals obtained from the assignment of values described above, the following graphic captures of the audio lines of both modalities were made.

The FIG. 22 illustrates the graphic representation that show us the graphic results after the audio triangular effect has been applied for both embodiments through hardware to the corresponding audio signals for each one of the three mono audio playback systems, therefore, this FIG. 22 allow us to appreciate the graphic representation of audio signal of each channel out of the present invention. It is important to mention that said assignment of values to obtain the audio signals for each one of the three mono audio playback systems for each one of the two embodiments could have been done through software of through hardware as previously described. It is important to reaffirm that said FIG. 22 show us the graphic results after the audio triangular effect has been applied to through hardware to the audio signals obtained from the previous assignment of values.

Location and Angles Needed for the Three Mono Audio Playback Systems for the Audio Triangular System 100.

The audio triangular system 100 comprises three mono audio playback systems, one in front of the listener, one on the left in relation to the listener and one on the right in relation to the listener.

Each mono audio playback system must comply with the following technical specifications as a minimal requirement for being applied to the audio triangular system 100 of the present invention:

Each one of the mono audio playback systems emit in a complete range of treble, mid and bass tones, with bass having a frequency of approximately 10 Hz to approximately 300 Hz, mid having a frequency of approximately 300 Hz to approximately 2.4 kHz, and treble having a frequency of approximately 2.4 kHz to approximately 20 kHz. The three mono audio playback systems must be of the same size and power and they shall be also calibrated to each other in relation to the volume and frequencies emitted by each mono audio playback system.

Figure 1:
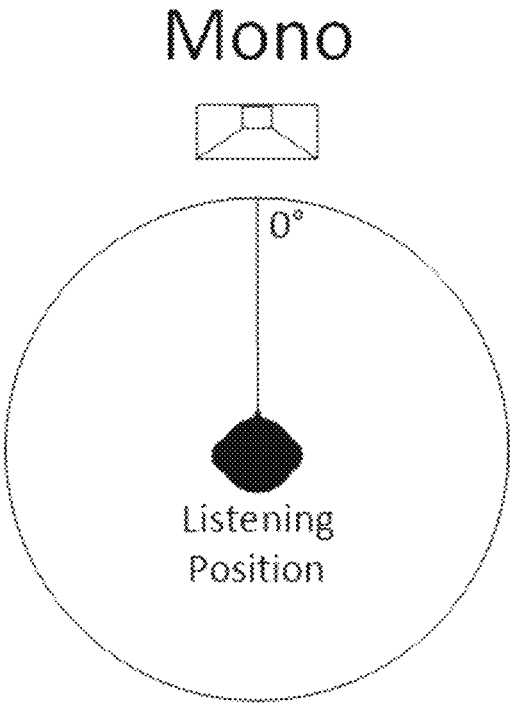
FIG. 1 illustrates the already known monophonic audio system is shown as a background reference, in which a single loudspeaker is used in front of the listener.
Figure 2:
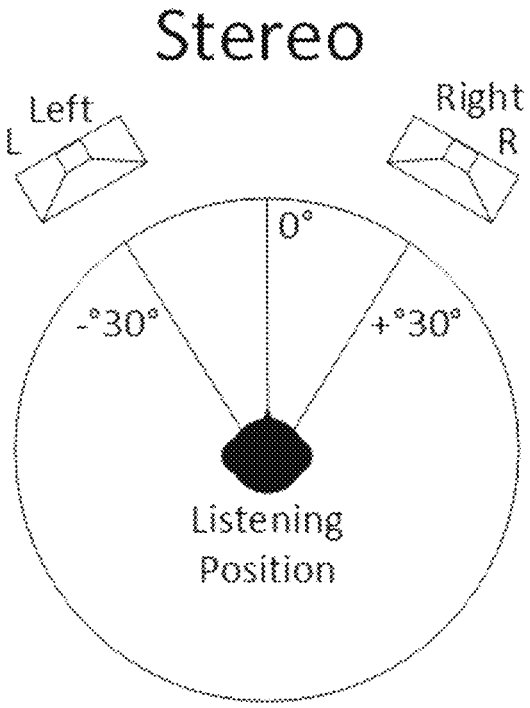
FIG. 2 illustrates the already known stereophonic audio system is shown as a background reference, in which a left loudspeaker to emit the left channel and a right loudspeaker to emit the right channel are used. Both loudspeakers are located in front of the listener at a 30° angle each in relation to the frontal equilibrium point at 0°.
Figure 3:
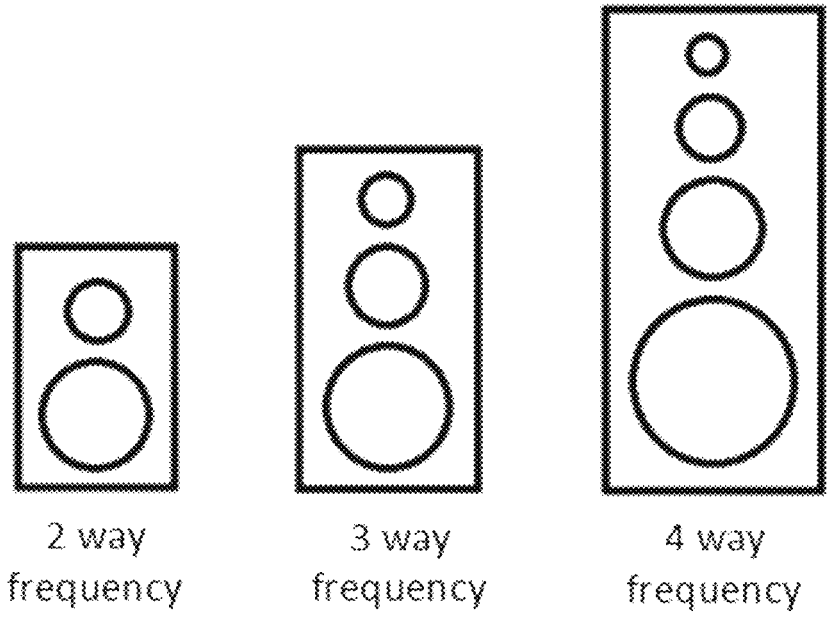
FIG. 3 illustrates the already known 2, 3 and 4 frequency ways loudspeakers are shown as background reference.
Figure 4:
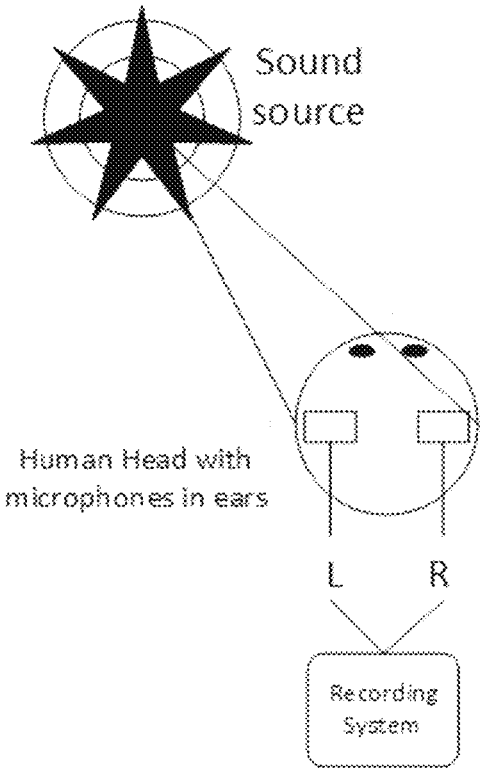
FIG. 4 illustrates a representation of the human-shaped microphone called Ringo which is used to record sounds in the holophony is shown as background reference.
Figure 5:
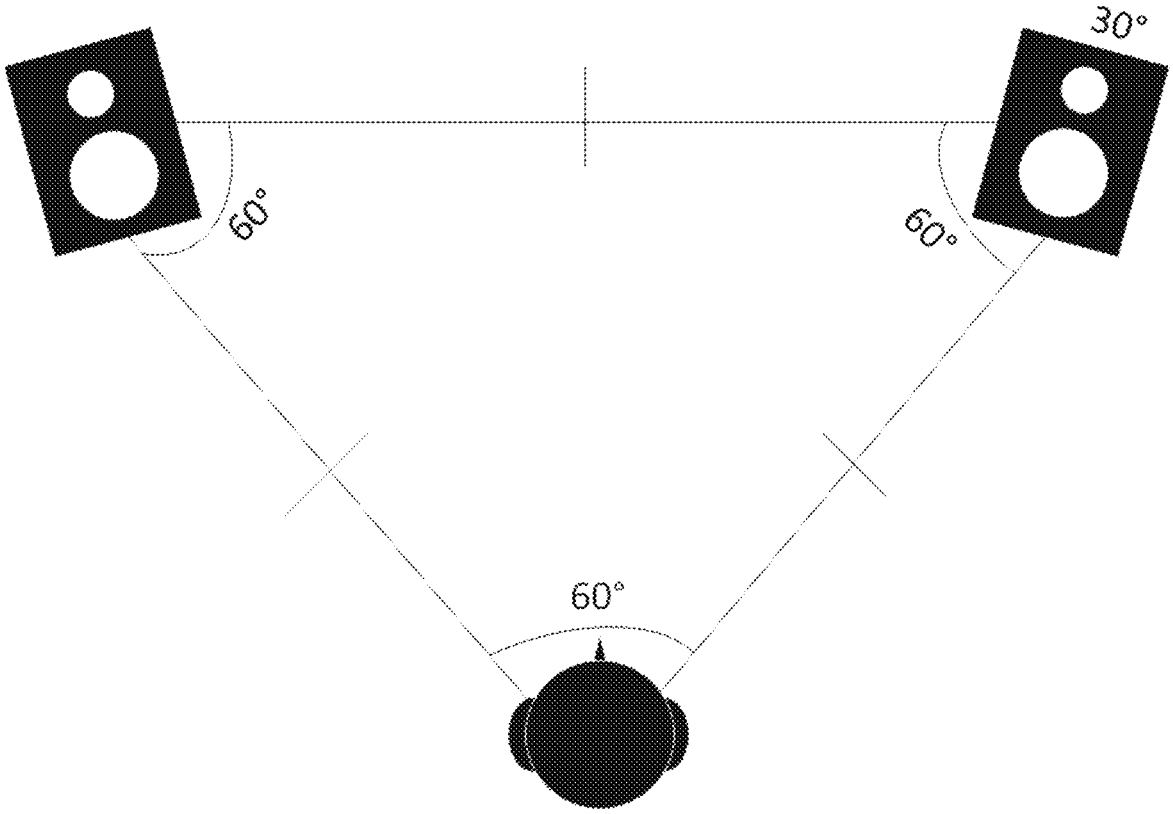
FIG. 5 illustrates a representation of the stereo audio system, including angles and positions of their loudspeakers in relation to the listener is shown as background reference.
Figure 6:
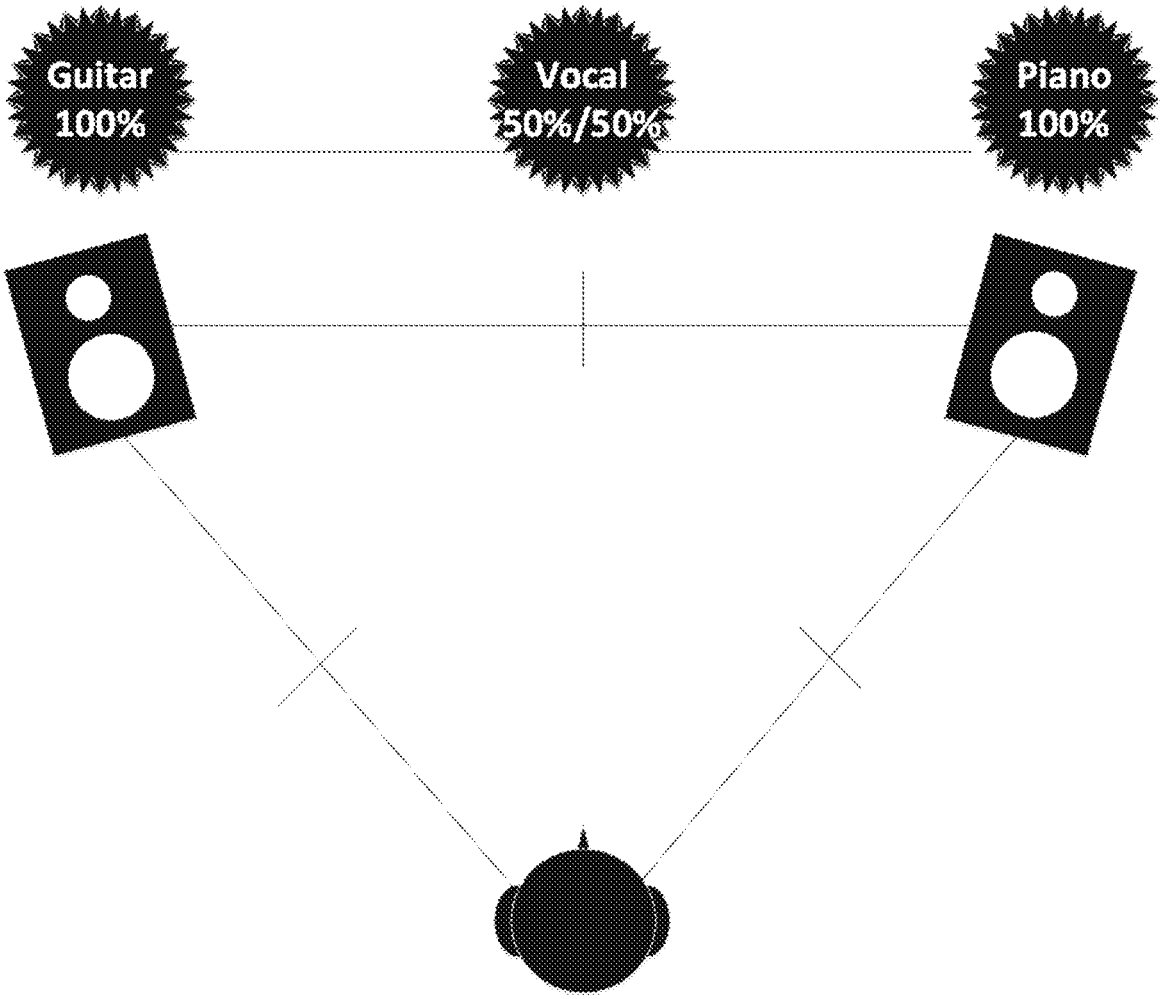
FIG. 6 illustrates a representation of the assignment of sounds in the left and right channels of a stereophonic mix including the midpoint named as "the phantom center" is shown as background reference.
Figure 7:
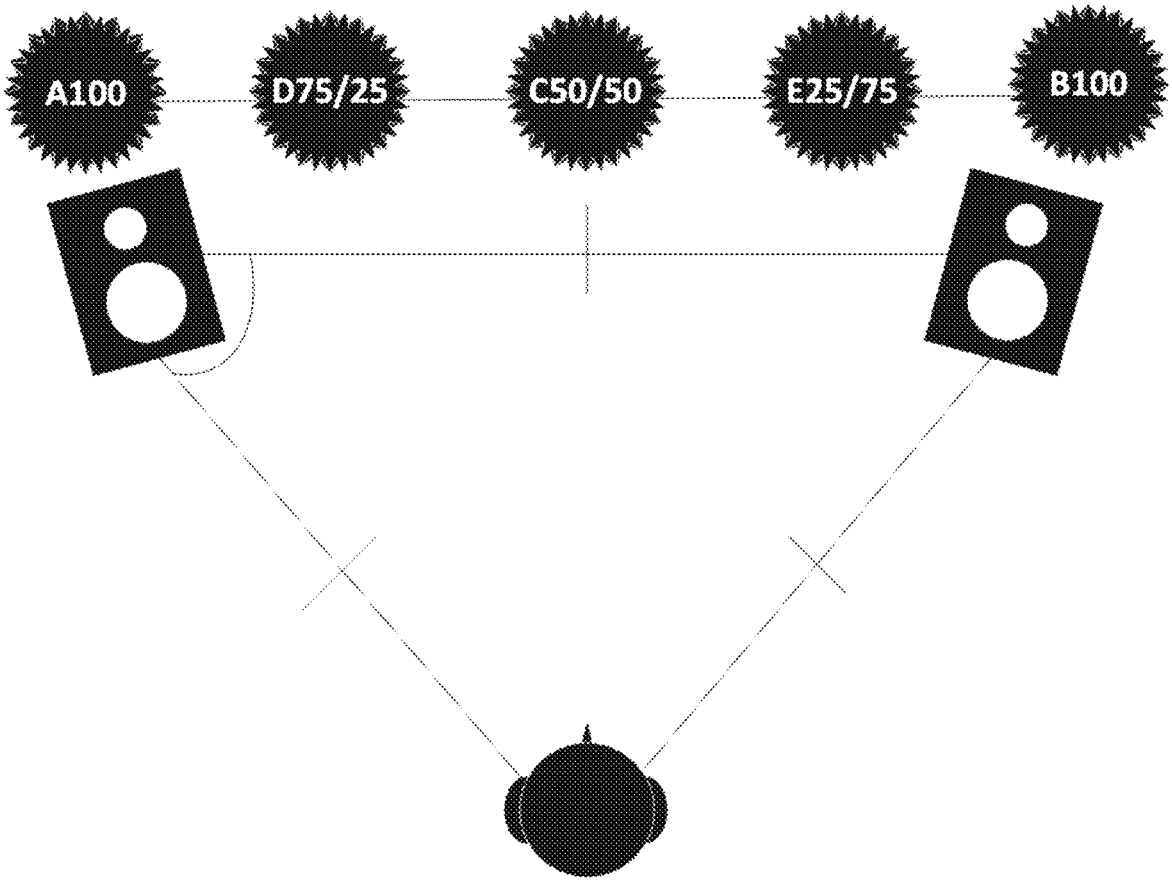
FIG. 7 illustrates a representation of the main 5 panning points in a stereophonic mix is shown as background reference.
Figure 8:
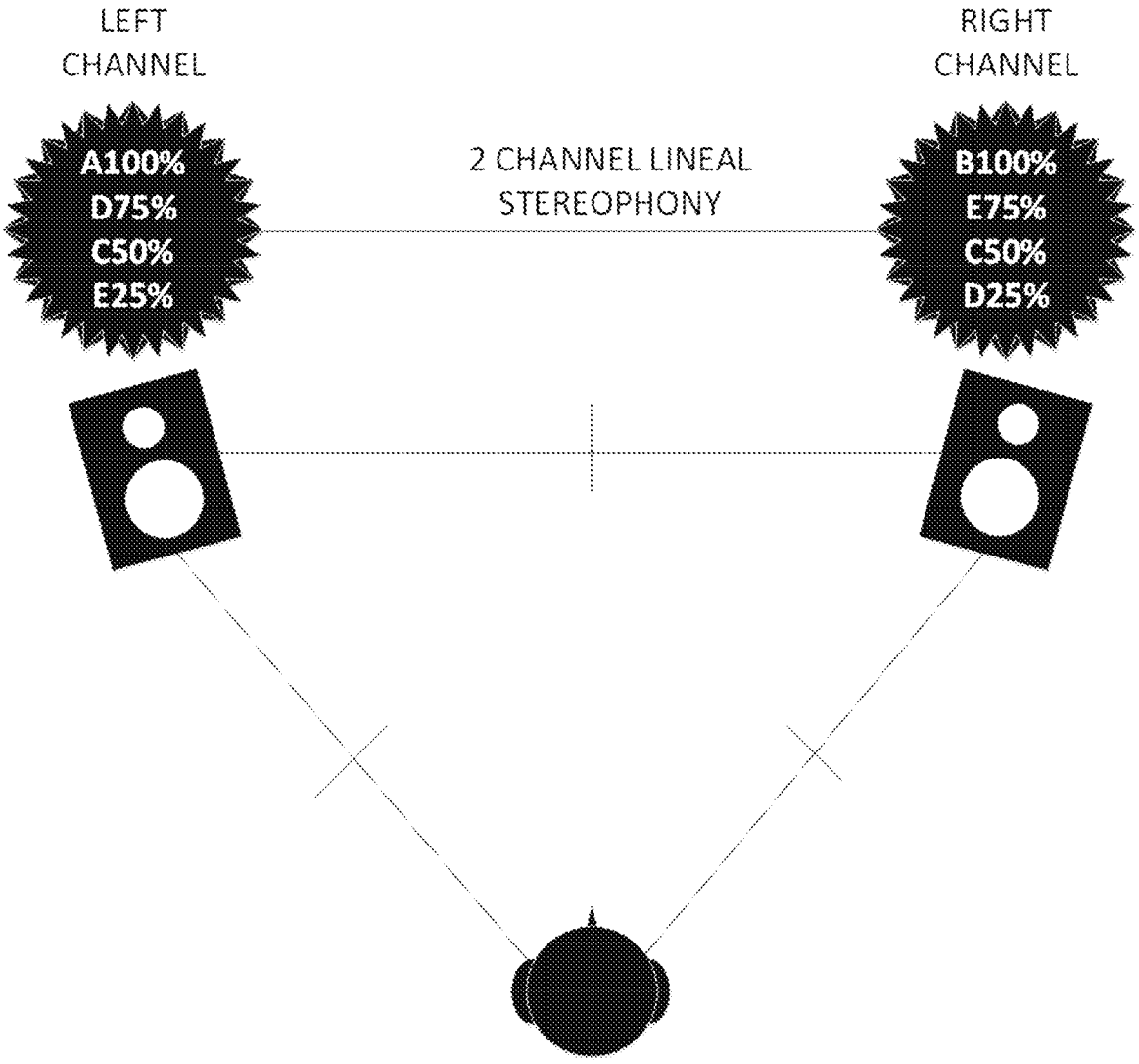
FIG. 8 illustrates a representation of the assignment of values of the left and right channels to achieve the main 5 panning points in the stereophonic is shown as background reference.
Figure 9:
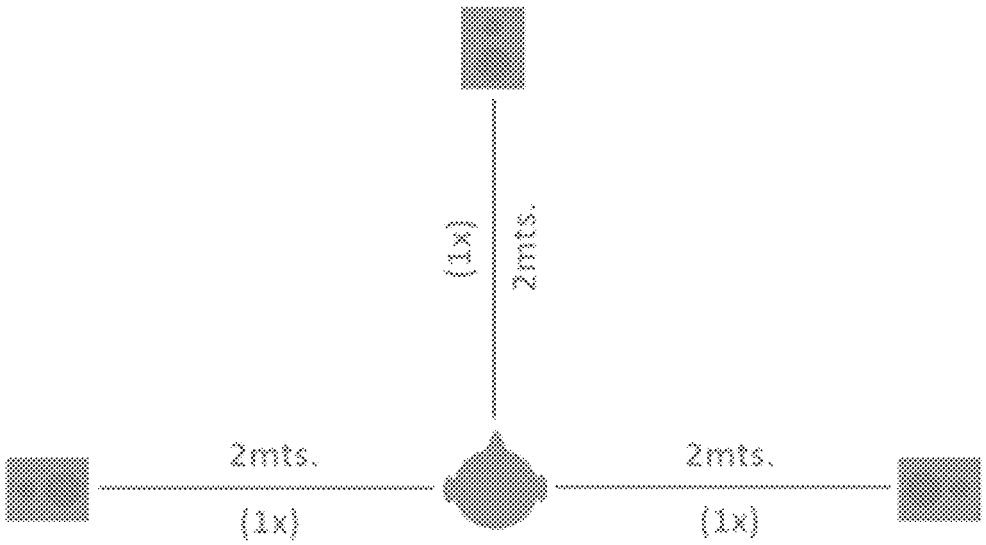
FIG. 9 illustrates the location of the mono audio playback systems in relation to the listener for the triangular audio system of the present invention is shown as a reference.

The rule of location of the mono audio playback systems for the audio triangular system 100 is that there must be the same distance (1×) between the listener and each mono audio playback system, that is to say, if the listener is located 2 meters from the front mono audio playback system, the lateral mono audio playback systems must be also aligned in relation to the listener and each one must be 2 meters away from him/her, forming an isosceles triangle, as can be seen in FIG. 9.

Figure 10:
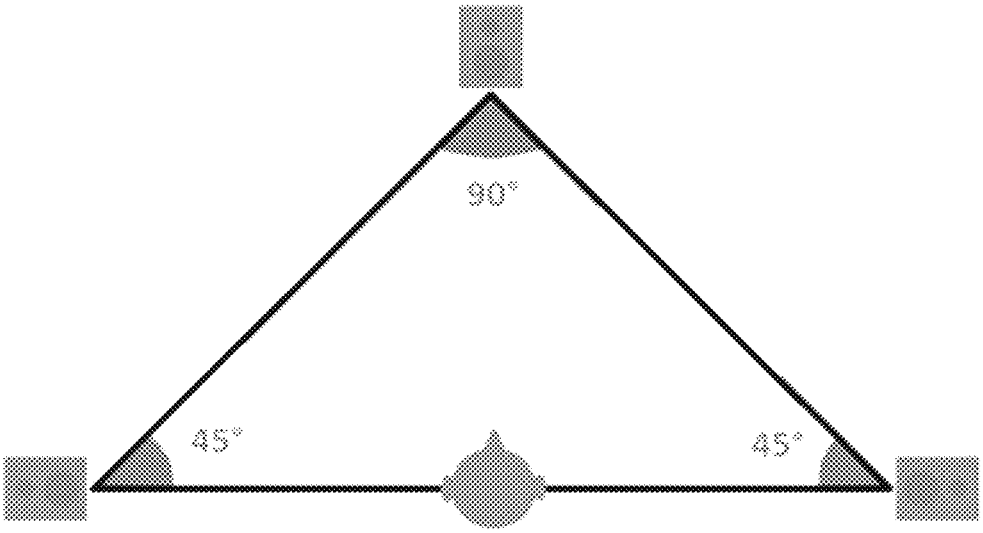
FIG. 10 illustrates the audio's triangular space created by the placement of the mono audio playback systems in the present invention is shown as a reference.

When creating an isosceles triangle with the location of the mono audio playback systems, the internal angles of the formed triangle must be delimited, the angle of the front corner must be 90 degrees, while the two angles of the side corners must be 45 degrees each. It should be noted that the three mono audio playback systems must be oriented to the head of the listener, as shown in FIG. 10.

It is important to mention that said location and angles necessary for the mono audio playback systems of the audio triangular systems 100 describe the ideal exemplary embodiment for listening the audio triangular system 100, since said location and angles specified above offer the maximum appreciation point towards the listener.

However, there is an embodiment in which the distance of the front mono audio playback system with relation to the listener can be modified when necessary due to the features of the space in which the playback equipment will be placed. This means that said front mono audio playback system may be placed closer or farther while it maintains the audio triangular system 100 effect. In order to achieve this, the formulas shown in the FIG. 17, which allows to calculate the relationship between the sound level (L) in decibels (dB) (what is known as sound pressure level or sound intensity level) depending on the distance (r). This formula is well known in the prior art. By correctly applying the abovementioned formula, the system of the present invention will continue being effective.

The above formula should only be allowed to modify the distance of the front mono audio playback system with relation to the listener. However, the distance of the lateral mono audio playback systems with relation to the listener always must be the same, that is to say, if the left mono audio playback system is at a distance (1×) with relation to the listener, the right mono audio playback system must be maintained to the same distance (1×) with relation to the listener.

Therefore, the distance between the front mono audio playback system and the listener can be increased or reduced as long as the abovementioned formula is correctly applied and both of the right and left lateral mono audio playback system are maintained at the same distance each one in relation to the listener.

Due to the specified above, it is important to understand that the inner angles of the triangle formed by the three mono audio playback systems are related with the distance that exists between the listener and each mono audio playback system. As a result, said angles will vary in accordance with the modification of the distance between the front mono audio playback system and the listener.

It is important to mention that the effect of the audio triangular system 100 is achieved by locating the three mono audio playback systems at the same distance in relation the listener. The effect will always be better than that which is achieved by modifying the distance of the front mono audio playback system in relation of the listener, in spite of having correctly used the abovementioned formula. The effect cannot be achieved otherwise due to the spatial geometry and harmony that is obtained when the three mono audio playback system are located at the same distance with relation to the listener.

Therefore, although the effect of the audio triangular system 100 can be appreciated in those cases in which is necessary to modify the distance between the front mono audio playback system and the listener by correctly using the aforementioned formula, this is not the best way to listen the audio that is generated by the present invention.

If the mono audio playback systems are not accommodated at the same separation distance in relation to the listener and the internal angles of the triangle formed by said mono audio playback systems are not respected, which correspond to the front corner with 90° and the two angles of the side corners with 45° each, as shown in FIG. 10, the optimal operation of the audio triangular system 100 would not achieved. It is important to understand that in those cases in which it is necessary to modify the distance between the front mono audio playback system and the listener, the inner angles of the formed triangle would be automatically modified, furthermore, it will be necessary to exactly use the aforementioned formula, so it is fundamental to respect these parameters for its effective operation.

The audio triangular system begins with the assignment of specific values to obtain the audio signals corresponding to each one of the mono audio playback system to create the audio triangular effect which generates the physical and virtual panning points in the contour of the triangle or frontal semicircle formed by the specific location of the mono audio playback systems. By this way it gives a specific and marked location to the sounds in relation to the original stereophonic mix and panning.

Because of the foregoing described for this invention, it is absolutely necessary that the following parameters be rigorously followed:

1) The assignment of the specific values to obtain the audio signals corresponding to each one of the three mono audio playback systems for its two embodiments $X_2$, $Z_2$, $Y_2$ and embodiment $X_2$, $Z_2$, $Y_2$ 2) Audio triangular effect of the present invention in its two embodiments $X_2$, $Z_2$, $Y_2$ and embodiment $X_3$, $Z_3$, $Y_3$.

3) The location, distances and angles of the three mono audio playback systems.

Otherwise, the audio triangular system 100 will not be effective.

Multichannel Replication

It is important to mention that the audio triangular system 100 described above can be simultaneously reproduced or replicated as many times as necessary for use in various applications. The terms "reproduce", or "replicate" should be understood as the simultaneous use of an additional audio triangular system 100 or several additional audio triangular systems 100 for an application in a particular device or system. In an exemplary, but not limitative way, the audio triangular system 100 of the present invention can be replicated as many times as necessary to apply it simultaneously into a multi-channel system in stereo pairs. By way of non-limiting example, the audio triangular system 100 of the present invention can be duplicated to be applied in multichannel systems with 4 channels formed by 2 stereo systems. In the same way, the audio triangular system 100 of the present invention can be tripled for its application in multichannel systems of 6 channels formed by 3 stereo systems. In another embodiment of the invention, the audio triangular system can be quadruple and applied in multichannel systems of 8 channels formed by 4 stereo systems. A person skilled in the art will appreciate that the audio triangular system 100 can be simultaneously replicated or reproduced as many times as necessary for its application for any one multi-channel system in stereo pairs.

Applications of the Audio Triangular System 100

The audio triangular system 100 will be scalable to different audio technologies such as:

1) Music
2) Streaming
3) Audio reproduction systems
4) Videogames
5) Virtual Reality
6) Headphones
7) Automobile In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claim.

What is claimed is:

1. A method for the generation and reproduction of triangular panning points to change the dimension of the panoramic structure of music or any stereophonic audio in the listener's acoustic space, which comprises:

i) assigning values to the panning points of an stereophonic audio through the fusion, complementation and elimination of said points to convert them into the three triangular panning audio signals resulting in $X_2$, $Z_2$ and $Y_2$, which is made through at least a software processor and/or an analog hardware system;

ii) creating an acoustic triangle through three mono audio playback systems in the physical space of the listener when reproducing the resulting audio signals $X_2$, $Z_2$ and $Y_2$ wherein said playback systems comprises a front audio playback system, and two lateral audio playback systems forming an isosceles right triangle, in which the distance between the listener and each mono audio playback system is equidistant, therefore a 90° angle is formed at the corner corresponding to the front audio playback system and a 45° angle is formed at the corners corresponding to the lateral audio playback systems, reproducing the resulting audio signals $X_2$, $Z_2$ and $Y_2$ through three mono audio playback systems comprising a front audio playback system and two lateral audio playback systems, where said playback systems are disposed forming an isosceles triangle in which the distance between the listener and each mono audio playback system is equidistant, and a 90° angle is formed at the corner corresponding to the front mono audio playback system and a 45° angle is formed at the corners corresponding to the lateral mono audio playback systems; and iii) creating a triangular panning point acoustic effect in the physical space of the listener through the disposition of the three mono audio playback systems and through the interaction between the audio signals $X_2$, $Z_2$ and $Y_2$ where after reproducing said signals and before being perceived by the listener, a collision between the audio waves emitted by each playback system occurs, which creates physical and virtual triangular panning points.

2. The method for the generation and reproduction of triangular panning points according to claim 1, wherein the step of assigning values additionally comprises processing the resulting triangular panning audio signals $X_2$, $Z_2$ and $Y_2$ with at least a software processor and/or an analog hardware system different from what is used for the creation of the signals $X_2$, $Z_2$ and $Y_2$, and that are configured to work additionally with the signals $X_2$, $Z_2$ and $Y_2$ to obtain the triangular panning audio signals $X_3$, $Z_3$ and $Y_3$ wherein said signals $X_3$, $Z_3$ and $Y_3$ are used in the steps ii) and iii) of the method.

3. The method for the generation and reproduction of triangular panning points according to claim 2, where said additional processing of audio signals $X_2$, $Z_2$ y $Y_2$ to obtain the audio signals $X_3$, $Z_3$ y $Y_3$ is carried out as follows:

i) assigning values to obtain the audio signal $X_3$ corresponding to the left lateral mono audio playback system as follows:

$$X_2 \mathfrak{T} L = X_3$$

$X_2$=(A100/D50/−E50/−B100) is merged with L=(A100/D75/C50/E25) obtaining as result $X_3$=(A200/D125/C50/−E25/−B100), wherein $X_2$ corresponds to the triangular panning point values previously obtained; L corresponds to the panning point values of the left channel and $X_3$ corresponds to the audio signal composed by triangular panning points for the left lateral mono audio playback system, ii) assigning values to obtain the audio signal $Y_3$ corresponding to the right lateral mono audio playback system as follows:

$$Y_2 \mathfrak{T} R = Y_3$$

$Y_2$=(−A100/−D50/E50/B100) is merged with R=(D25/C50/E75/B100) obtaining as result $Y_3$=(−A100/−D25/C50/E125/B200), wherein $Y_2$ corresponds to the triangular panning point values previously obtained; R corresponds to the panning point values of the right channel and $Y_3$ corresponds to the audio signal composed by triangular panning points for the right lateral mono audio playback system;

iii) assigning values to obtain the audio signal $Z_3$ corresponding to the front mono audio playback system as follows:

$$X_3 \mathfrak{T} Y_3 = Z_3$$

$X_3$=(A200/D125/C50/−E25/−B100) is merged with $Y_3$=(−A100/−D25/C50/E125/B200) obtaining as result $Z_3$=(A100/D100/C100/E100/B100), wherein $X_3$ corresponds to the triangular panning point values of the left audio signal; $Y_3$ corresponds to the triangular panning point values of the right audio signal; and $Z_3$ corresponds to the audio signal composed by triangular panning points for the front mono audio playback system, wherein A, B, C, D, E=Panning points L=Left Channel R=Right Channel $\mathfrak{X}$=Merge $X_3$=Audio signal for the left lateral mono system $Y_3$=Audio signal for the right lateral mono system $Z_3$=Audio signal for the front mono system.

4. The method for the generation and reproduction of triangular panning points according to claim 2, wherein the creation of the acoustic effect in the physical space of the listener occurs when the audio signal $Z_3$ emitted by the front mono audio playback system interacts with the audio signal $X_3$ emitted by the left lateral mono audio playback system and at the same time with the audio signal $Y_3$ emitted by the right lateral mono audio playback system, wherein the audio signals $X_3$ and $Y_3$ emitted by the lateral mono audio playback systems don't interact with each other because the distance between said mono audio playback systems is almost twice the distance they have with the front mono audio playback system, wherein said mono audio playback systems are disposed to form an isosceles right triangle in the physical space of the listener, giving as result the appreciation of physical and virtual triangular panning points A, D, C, E, B at the boundaries of the triangle formed, wherein:

the audio signal for the left lateral mono audio playback system $X_3$ in interaction with the audio signal for the front mono audio playback system $Z_3$ gives us as result the triangular effect $\Delta X_3$ to create the panning points "AD", the audio signal for the right lateral mono audio playback system $Y_3$ in interaction with the audio signal for the front mono audio playback system $Z_3$ gives us as result the triangular effect $\Delta Y_3$ to create the panning points "BE", the audio signal for the left lateral mono audio playback system $X_3$ in interaction with the audio signal for the front mono audio playback system $Z_3$ and at the same time the audio signal for the right lateral mono audio playback system $Y_3$ in interaction with the audio signal for the front mono audio playback system $Z_3$ gives us as result the triangular effect $\Delta Z_3$ to create the panning points "CDE"

$$\overset{X_3}{(A200/D125/C50/-E25/-B100)}\mathfrak{X}\overset{Z_3}{(A100/D100/C100/E100/B100)}$$

$$\mathfrak{X}\overset{Y_3}{(-A100/-D25/C50/E125/B200)}$$

$$=\overset{\Delta X_3}{(A200/D125)}\overset{\Delta Z_3}{(D75/C200/E75)}\overset{\Delta Y_3}{(E125/B200)}$$

triangular effect $\Delta X_3$=(panning point A200%+panning point D125%)

triangular effect $\Delta Z_3$=(panning point D75%+panning point C200%+panning point E75%)

triangular effect $\Delta Y_3$=(panning point E125%+panning point B200%)

wherein said interaction happens in the acoustic space of the listener, which is carried out by the elimination of negative percentages with positive percentages of the same triangular panning points represented by the same letter;

wherein the −B100 value of the left lateral mono audio playback system is eliminated by interacting with the B100 of the front mono audio playback system, eliminating completely both values for both mono audio playback systems in the audio triangular space;

wherein the −A100 value of the right lateral mono audio playback system eliminates the A100 value of the front mono audio playback system, eliminating completely both values for both mono audio playback systems in the audio triangular space;

wherein the −E25 value of the left lateral mono audio playback system is eliminated by interacting with the E100 of the front mono audio playback system, leaving as new value E75 for the front mono audio playback system. This new E75 value can now interact with the E125 value of the right lateral mono audio playback system, as being the result of a previous interaction, the positives can be added creating the audio triangular panning point with its E200 value which will be perceived right in the middle between the location of the right lateral mono audio playback system and the front mono audio playback system in the audio triangular space;

wherein the −D25 value of the right lateral mono audio playback system is eliminated by interacting with the D100 of the font mono audio playback system, leaving as new value D75 for the front central mono audio playback system. This new D75 value can now interact with the D125 value of the left lateral mono audio playback system, as being the result of a previous interaction, the positives can be added creating the audio triangular panning point with its D200 value which will be perceived right in the middle between the location of the left lateral mono audio playback system and the front mono audio playback system in the audio triangular space;

wherein the C50 value of the left lateral mono audio playback system interact with the C100 value of the front mono audio playback system and at the same time the C50 value of the right lateral mono audio playback system interact with the C100 value of the front mono audio playback system creating the audio triangular panning point with its C200 value which will be perceived where the front mono audio playback system is located in the audio triangular space;

wherein the A200 value of the left lateral mono audio playback system cannot eliminate any value from the front mono audio playback system since the A100 contained by the front mono audio playback system has already been previously eliminated, creating the audio triangular panning point with its A200 value which will be perceived where the left lateral mono audio playback system is located in the audio triangular space;

wherein the B200 value of the right lateral mono audio playback system cannot eliminate any value from the front mono audio playback system since the B100 contained by the front mono audio playback system has already been previously eliminated, creating the audio triangular panning point with its B200 value which will be perceived where the right lateral mono audio playback system is located in the audio triangular space.

5. The method for the generation and reproduction of triangular panning points according to claim 2, where said three mono audio playback systems are disposed to form an isosceles right triangle in the physical space of the listener, placing a front audio playback system in relation to the listener, placing a front audio playback system in relation to the listener and two lateral audio playback systems in relation to the listener, applying a distance of 1× between the listener and each mono audio playback system, being "x" the representation of any longitude, which generates a 90° angle at the corner that correspond to the front audio playback system and a 45° angle for the corners that correspond to the lateral audio playback systems, wherein said playback systems emit the audio signals as follows: the mono audio playback system located at the front corner emits the audio signal $Z_3$, the mono audio playback system located at the left lateral corner emits the audio signal $X_3$ and the mono audio playback system located at the right lateral corner emits the audio signal $Y_3$, wherein said audio signals were obtained in the triangular panning point assigning values step.

6. The method for the generation and reproduction of triangular panning points according to claim 5, that additionally comprises a step to adjust the distance between the listener and the front mono audio playback system by varying the reproduced signal decibels.

7. The method for the generation and reproduction of triangular panning points according to claim 2, wherein the method can be simultaneously applied to each channel pair of a multichannel system composed by stereophonic channel pairs, wherein said multichannel system can be composed by 2, 3, 4 or more stereophonic channel pairs, wherein each audio signal correspondent to each audio channel is different and independent from each other.

8. The method for the generation and reproduction of triangular panning points according to claim 1, wherein the process of assigning values to obtain the audio signals $X_2$, $Z_2$ and $Y_2$ is carried out as follows:

i) assigning values to obtain the audio signal $X_2$ corresponding to the left lateral mono audio playback system as follows:

$$R \mathfrak{T} 180° = W$$

R=(D25/C50/E75/B100) is merged at 180° resulting in W(−D25/−C50/−E75/−B100);

$$W \mathfrak{T} L = X_2$$

W=(−D25/−C50/−E75/−B100) is merged with L=(A100/D75/C50/E25) obtaining as result $X_2$=(A100/D50/−E50/−B100), wherein R corresponds to the panning points values of the right channel, W corresponds to the panning points values of the right channel merged at 180°, L corresponds to the panning points values of the left channel and $X_2$ corresponds to the audio signal composed by triangular panning points for the left lateral mono audio playback system, ii) assigning values to obtain the audio signal $Y_2$ corresponding to the right lateral mono audio playback system as follows:

$$L \mathfrak{T} 180° = M$$

L=(A100/D75/C50/E25) is merged at 180° resulting in M(−A100/−D75/−C50/−E25);

$$M \mathfrak{T} R = Y_2$$

M=(−A100/−D75/−C50/−E25) is merged with R=(D25/C50/E75/B100) obtaining as result $Y_2$=(−A100/−D50/E50/B100), wherein L corresponds to the panning point values of the left channel, M corresponds to the panning point values of the left channel merged at 180°, R corresponds to the panning point values of the right channel and $Y_2$ corresponds to the audio signal composed by triangular panning points for the right lateral mono audio playback system iii) assigning values to obtain the audio signal $Z_2$ corresponding to the front mono audio playback system as follows:

$$L \mathfrak{T} R = Z_2$$

L=(A100/D75/C50/E25) is merged with R=(D25/C50/E75/B100) obtaining as result $Z_2$=(A100/D100/C100/E100/B100)

wherein L corresponds to the panning point values of the left lateral channel, R corresponds to the panning point values of the right lateral channel and $Z_2$ corresponds to the audio signal composed by triangular panning points for the front mono audio playback system, wherein A, B, C, D, E=Panning points L=Left Channel R=Right Channel $\mathfrak{T}$=Merge $X_2$=Audio signal for the left lateral mono system $Y_2$=Audio signal for the right lateral mono system $Z_2$=Audio signal for the front mono system.

9. The method for the generation and reproduction of triangular panning points according to claim 1, wherein the creation of the acoustic effect in the physical space of the listener occurs when the audio signal $Z_2$ emitted by the front mono audio playback system interacts with the audio signal $X_2$ emitted by the left lateral mono audio playback system and at the same time with the audio signal $Y_2$ emitted by the right lateral mono audio playback system, wherein the audio signals $X_2$ and $Y_2$ emitted by the lateral mono audio playback systems don't interact with each other because the distance between said mono audio playback systems is almost twice the distance they have with the front mono audio playback system, wherein said mono audio playback systems are disposed to form an isosceles right triangle in the physical space of the listener, giving as result the appreciation of physical and virtual triangular panning points A, D, C, E, B at the boundaries of the triangle formed, wherein:

the audio signal for the left lateral mono audio playback system $X_2$ in interaction with the audio signal for the front mono audio playback system $Z_2$ gives us as result the triangular effect $\Delta X_2$ to create the panning points "AD", the audio signal for the right lateral mono audio playback system $Y_2$ in interaction with the audio signal for the front mono audio playback system $Z_2$ gives us as result the triangular effect $\Delta Y_2$ to create the panning points "BE", the audio signal for the left lateral mono audio playback system $X_2$ in interaction with the audio signal for the front mono audio playback system $Z_2$ and at the same time the audio signal for the right lateral mono audio playback system $Y_2$ in interaction with the audio signal for the front mono audio playback system $Z_2$ gives us as result the triangular effect $\Delta Z_2$ to create the panning points "CDE", $$(A100/D50/\overset{X_2}{-E50}/-B100)\mathcal{X}(A100/D100/\overset{Z_2}{C100}/E100/B100)$$
$$\mathcal{X}(-A100/\overset{Y_2}{-D50}/E50/B100)$$
$$=(\overset{\Delta X_2}{A100/D50})(\overset{\Delta Z_2}{D50/C100}/E50)(\overset{\Delta Y_2}{E50/B100})$$

triangular effect $\Delta X_2$=(panning point A100%+panning point D50%)

triangular effect $\Delta Z_2$=(panning point D50%+panning point C100%+panning point E50%)

triangular effect $\Delta Y_2$=(panning point E50%+panning point B100%)

wherein said interaction happens in the acoustic space of the listener, which is carried out by the elimination of negative percentages with positive percentages of the same triangular panning points represented by the same letter;

wherein the −B100 value of the left lateral mono audio playback system is eliminated by interacting with the B100 of the front mono audio playback system, eliminating completely both values for both mono audio playback systems in the audio triangular space;

wherein the −A100 value of the right lateral mono audio playback system eliminates the A100 value of the front mono audio playback system, eliminating completely both values for both mono audio playback systems in the audio triangular space;

wherein the −E50 value of the left lateral mono audio playback system is eliminated by interacting with the E100 of the front mono audio playback system, leaving a new value for the front mono audio playback system E50, This new E50 value can now interact with the E50 value of the right lateral mono audio playback system, as being the result of a previous interaction, the positives can be added creating the audio triangular panning point with its E100 value which will be perceived right in the middle between the location of the right lateral mono audio playback system and the front mono audio playback system in the audio triangular space;

wherein the −D50 value of the right lateral mono audio playback system is eliminated by interacting with the D100 of the front mono audio playback system, leaving as new value D50 for the front mono audio playback system. This new D50 value can now interact with the D50 value of the left lateral mono audio playback system, as being the result of a previous interaction, the positives can be added creating the audio triangular panning point with its D100 value which will be perceived right in the middle between the location of the left lateral mono audio playback system and the front mono audio playback system in the audio triangular space;

wherein the A100 value of the left lateral mono audio playback system cannot eliminate any value from the front mono audio playback system since the A100 contained by the front mono audio playback system has already been previously eliminated, creating the audio triangular panning point with its A100 value which will be perceived where the left lateral mono audio playback system is located in the audio triangular space;

wherein the B100 value of the right lateral mono audio playback system cannot eliminate any value from the front mono audio playback system since the B100 contained by the front mono audio playback system has already been previously eliminated, creating the audio triangular panning point with its B100 value which will be perceived where the right lateral mono audio playback system is located in the audio triangular space;

wherein after the interaction of both lateral mono audio playback systems with the front mono audio playback system, its created the audio triangular panning point with its C100 value which will be perceived where the right lateral mono audio playback system is located in the audio triangular space, wherein:

A, B, C, D, E=Panning points

Δ=Audio triangular effect $\mathcal{X}$=Interaction $Z_2$=Audio signal for the front mono system $X_2$=Audio signal for the left lateral mono system $Y_2$=Audio signal for the right lateral mono system.

10. The method for the generation and reproduction of triangular panning points according to claim 1, wherein said three mono audio playback systems are disposed to form an isosceles right triangle in the physical space of the listener, placing a front audio playback system in relation to the listener and two lateral audio playback systems in relation to the listener, applying a distance of 1× between the listener and each mono audio playback system, being "x" the representation of any longitude, which generates a 90° angle at the corner that correspond to the front audio playback system and a 45° angle for the corners that correspond to the lateral audio playback systems, wherein said playback systems emit the audio signals as follows: the mono audio playback system located at the front corner emits the audio signal $Z_2$, the mono audio playback system located at the left lateral corner emits the audio signal $X_2$ and the mono audio playback system located at the right lateral corner emits the audio signal $Y_2$, wherein said audio signals were obtained in the triangular panning point assigning values step.

11. The method for the generation and reproduction of triangular panning points according to claim 10, that additionally comprises a step to adjust the distance between the listener and the front mono audio playback system by varying the reproduced signal decibels.

12. The method for the generation and reproduction of triangular panning points according to claim 1, wherein the method can be simultaneously applied to each channel pair of a multichannel system composed by stereophonic channel pairs, wherein said multichannel system can be composed by 2, 3, 4 or more stereophonic channel pairs, wherein each audio signal correspondent to each audio channel is different and independent from each other.

13. A system for the generation and reproduction of triangular panning points to change the dimension of the panoramic structure of the music or any stereophonic audio in the acoustic space of the listener, which comprises:

i) at least a software processor and/or an analog hardware system to assign the panning point values of an stereophonic audio through the fusion, complementation and elimination of said points to convert them into three triangular panning audio signals resulting in $X_2$, $Z_2$ and $Y_2$; and ii) three mono audio playback systems to create an acoustic triangle in the physical space of the listener by reproducing the resulting audio signals $X_2$, $Z_2$ and $Y_2$ wherein said playback systems comprises a front audio playback system, and two lateral audio playback systems forming an isosceles right triangle, in which the distance between the listener and each mono audio playback system is equidistant, therefore a 90° angle is formed at the corner corresponding to the front audio playback system and a 45° angle is formed at the corners corresponding to the lateral audio playback systems; wherein the disposition of three mono audio playback systems and through the interaction between the audio signals $X_2$, $Z_2$ and $Y_2$ where after reproducing said signals and before being perceived by the listener creates an acoustic effect as result of the collision between the audio waves emitted by each playback system, which creates physical and virtual triangular panning points.

14. The system for the generation and reproduction of triangular panning points according to claim 13, wherein at least one of the software processors and/or an analog hardware system different from what is used for the creation of the signals $X_2$, $Z_2$ and $Y_2$, are configured to work additionally with the signals $X_2$, $Z_2$ and $Y_2$ to obtain the triangular panning audio signals $X_3$, $Z_3$ and $Y_3$ wherein said signals $X_3$, $Z_3$ and $Y_3$ are reproduced through the three mono audio playback systems; wherein the disposition of three mono audio playback systems and through the interaction between the audio signals $X_2$, $Z_2$ and $Y_2$ where after reproducing said signals and before being perceived by the listener creates an acoustic effect as result of the collision between the audio waves emitted by each playback system, which creates physical and virtual triangular panning points.

15. The system for the generation and reproduction of triangular panning points according to claim 14, which comprises a computer software, and a non-transitory computer-readable media programmed with computer-readable code that makes the processor to execute the triangular panning point values assignment step that is described in claim 8 to generate the audio signals $X_3$, $Z_3$ and $Y_3$.

16. The system for the generation and reproduction of triangular panning points according to claim 14, which comprises an analog or digital hardware device adapted at an embedded electrical circuit card to perform the triangular panning point values assignment step that is described in claim 3 to generate the audio signals $X_3$, $Z_3$ and $Y_3$.

17. The system for the generation and reproduction of triangular panning points according to claim 14, which comprises three mono audio playback systems that are disposed to form an isosceles right triangle in the physical space of the listener, placing a front audio playback system in relation to the listener and two lateral audio playback systems in relation to the listener, applying a distance of 1× between the listener and each mono audio playback system, being "x" the representation of any longitude, which generates a 90° angle at the corner that correspond to the front audio playback system and a 45° angle for the corners that correspond to the lateral audio playback systems, wherein said playback systems emit the audio signals as follows: the mono audio playback system located at the front corner emits the audio signal $Z_3$, the mono audio playback system located at the left lateral corner emits the audio signal $X_3$ and the mono audio playback system located at the right lateral corner emits the audio signal $Y_3$, wherein said audio signals were obtained through the software or hardware that performed the triangular panning point assigning values step as described in claim 3.

18. The system for the generation and reproduction of triangular panning points according to claim 17, wherein said audio playback equipment additionally comprises a hardware or software medium/control to adjust the distance between the listener and the front mono audio playback system by varying the reproduced signal decibels.

19. The system for the generation and reproduction of triangular panning points according to claim 14, wherein the triangular audio system can be simultaneously applied to each channel pair of a multichannel system composed by stereophonic channel pairs, wherein said multichannel system can be composed by 2, 3, 4 or more stereophonic channel pairs, wherein each audio signal correspondent to each audio channel is different and independent from each other.

20. The system for the generation and reproduction of triangular panning points according to claim 13, which comprises a computer software, and a non-transitory computer-readable media programmed with computer-readable code that makes the processor to execute the triangular panning point values assignment step that is described in claim 8 to generate the audio signals $X_2$, $Z_2$ and $Y_2$.

21. The system for the generation and reproduction of triangular panning points according to claim 13, which comprises an analog or digital hardware device adapted at an embedded electrical circuit card to perform the triangular panning point values assignment step that is described in claim 8 to generate the audio signals $X_2$, $Z_2$ and $Y_2$.

22. The system for the generation and reproduction of triangular panning points according to claim 13, which comprises three mono audio playback systems that are disposed to form an isosceles right triangle in the physical space of the listener, placing a front audio playback system in relation to the listener and two lateral audio playback systems in relation to the listener, applying a distance of 1× between the listener and each mono audio playback system, being "x" the representation of any longitude, which generates a 90° angle at the corner that correspond to the front audio playback system and a 45° angle for the corners that correspond to the lateral audio playback systems, wherein said playback systems emit the audio signals as follows: the mono audio playback system located at the front corner emits the audio signal $Z_2$, the mono audio playback system located at the left lateral corner emits the audio signal $X_2$ and the mono audio playback system located at the right lateral corner emits the audio signal $Y_2$, wherein said audio signals were obtained through the software or hardware that performed the triangular panning point assigning values step as described in claim 8.

23. The system for the generation and reproduction of triangular panning points according to claim 22, wherein said audio playback equipment additionally comprises a hardware or software medium/control to adjust the distance between the listener and the front mono audio playback system by varying the reproduced signal decibels.

24. The system for the generation and reproduction of triangular panning points according to claim 13, wherein the triangular audio system can be simultaneously applied to each channel pair of a multichannel system composed by stereophonic channel pairs, wherein said multichannel system can be composed by 2, 3, 4 or more stereophonic channel pairs, wherein each audio signal correspondent to each audio channel is different and independent from each other.

* * * * *